US011138880B2

(12) United States Patent
Smith et al.

(10) Patent No.: US 11,138,880 B2
(45) Date of Patent: Oct. 5, 2021

(54) VEHICLE-SOURCED INFRASTRUCTURE QUALITY METRICS

(71) Applicant: 3M INNOVATIVE PROPERTIES COMPANY, St. Paul, MN (US)

(72) Inventors: Kenneth L. Smith, White Bear Lake, MN (US); Justin M. Johnson, Hudson, WI (US); James B. Snyder, Minneapolis, MN (US); James W. Howard, Circle Pines, MN (US); Michael E. Hamerly, Vadnais Heights, MN (US); Onur Sinan Yordem, St. Paul, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 16/634,206

(22) PCT Filed: Sep. 28, 2018

(86) PCT No.: PCT/US2018/053284
§ 371 (c)(1),
(2) Date: Jan. 27, 2020

(87) PCT Pub. No.: WO2019/067826
PCT Pub. Date: Apr. 4, 2019

(65) Prior Publication Data

US 2020/0219391 A1 Jul. 9, 2020

Related U.S. Application Data

(60) Provisional application No. 62/565,866, filed on Sep. 29, 2017, provisional application No. 62/597,412, filed on Dec. 11, 2017.

(51) Int. Cl.
*G08G 1/097* (2006.01)
*E01C 23/01* (2006.01)
(Continued)

(52) U.S. Cl.
CPC ..... *G08G 1/097* (2013.01); *E01C 23/01* (2013.01); *G06Q 50/26* (2013.01); *G06Q 50/30* (2013.01);
(Continued)

(58) Field of Classification Search
CPC .. G08G 1/097; G08G 1/0112; G08G 1/09623; G08G 1/096708; G08G 1/096783; E01C 23/01; G06Q 50/26; G06Q 50/30
See application file for complete search history.

(56) References Cited

U.S. PATENT DOCUMENTS 4,581,325 A 4/1986 Kitchin et al.
6,677,030 B2 1/2004 Thakkar et al.
(Continued)

FOREIGN PATENT DOCUMENTS

EP 0416742 3/1991
WO WO-2010045539 A2 * 4/2010 ..... B61L 23/042
(Continued)

OTHER PUBLICATIONS

International Search report for PCT International Application No. PCT/US2018/053284 dated Jan. 30, 2019, 5 pages.

*Primary Examiner* — Emily C Terrell

(57) ABSTRACT

In some examples, a computing device includes one or more computer processors, a communication device, and a memory comprising instructions that cause the one or more computer processors to: receive, using the communication device and from a set of vehicles, different sets of infrastructure data for a particular infrastructure article that is proximate to each respective vehicle of the set of vehicles, wherein each respective vehicle in the set of vehicles comprises at least one infrastructure sensor that generates infrastructure data descriptive of infrastructure articles that are proximate to the respective vehicle; determine, based at least in part on the different sets of infrastructure data for the
(Continued)

particular infrastructure article from each respective vehicle of the set of vehicles, a quality metric for the infrastructure article; and perform at least one operation based at least in part on the quality metric for the infrastructure article.

19 Claims, 6 Drawing Sheets

(51) Int. Cl.

| | |
|---|---|
| ***G06Q 50/30*** | (2012.01) |
| ***G08G 1/01*** | (2006.01) |
| ***G08G 1/0962*** | (2006.01) |
| ***G08G 1/0967*** | (2006.01) |
| ***G06Q 50/26*** | (2012.01) |

(52) U.S. Cl.
CPC ..... *G08G 1/0112* (2013.01); *G08G 1/09623* (2013.01); *G08G 1/096708* (2013.01); *G08G 1/096783* (2013.01)

(56) References Cited

U.S. PATENT DOCUMENTS

| | | | |
|---|---|---|---|
| 7,068,434 | B2 | 6/2006 | Florczak et al. |
| 7,068,464 | B2 | 6/2006 | Dee |
| 7,387,393 | B2 | 6/2008 | Reich et al. |
| 7,421,334 | B2 | 9/2008 | Dahlgren et al. |
| 7,422,334 | B2 | 9/2008 | Smith |
| 7,611,251 | B2 | 11/2009 | Thakkar et al. |
| 8,865,293 | B2 | 10/2014 | Smithson et al. |
| 8,950,877 | B2 | 2/2015 | Northey et al. |
| 2013/0034682 | A1 | 2/2013 | Free et al. |
| 2013/0114142 | A1 | 5/2013 | Free et al. |
| 2013/0114143 | A1 | 5/2013 | Thakkar et al. |
| 2014/0062725 | A1 | 3/2014 | Maston |
| 2014/0078587 | A1 | 3/2014 | Orensteen et al. |
| 2014/0368902 | A1 | 12/2014 | Patel et al. |
| 2015/0012510 | A1 | 1/2015 | Van der Laan et al. |
| 2015/0043074 | A1 | 2/2015 | Patel et al. |
| 2015/0254986 | A1 | 9/2015 | Fairfield et al. |
| 2016/0132705 | A1 | 5/2016 | Kovarik et al. |
| 2017/0075355 | A1 | 3/2017 | Micks et al. |
| 2017/0123428 | A1 | 5/2017 | Levinson et al. |
| 2017/0193312 | A1* | 7/2017 | Ai ..... G06F 13/20 |
| 2019/0132709 | A1* | 5/2019 | Graefe ..... H04W 4/38 |
| 2020/0034590 | A1* | 1/2020 | Howard ..... G06K 7/1417 |

FOREIGN PATENT DOCUMENTS

| | | | | |
|---|---|---|---|---|
| WO | WO 2011-129382 | | 10/2011 | |
| WO | WO 2015-148426 | | 10/2015 | |
| WO | WO 2017-151202 | | 9/2017 | |
| WO | WO-2018064203 | A1 * | 4/2018 | ..... G06K 19/06037 |
| WO | WO-2018064212 | A1 * | 4/2018 | ..... G08G 1/09623 |

* cited by examiner

VEHICLE-SOURCED INFRASTRUCTURE QUALITY METRICS

CROSS REFERENCE TO RELATED APPLICATIONS

This application is a national stage filing under 35 U.S.C. 371 of PCT/US2018/053284, filed Sep. 28, 2018, which claims the benefit of U.S. Provisional Application Nos. 62/565,866, filed Sep. 29, 2017, and 62/597,412, filed Dec. 11, 2017, the disclosures of which are incorporated by reference in their entireties herein.

TECHNICAL FIELD

The present application relates generally to pathway articles and systems in which such pathway articles may be used.

BACKGROUND

Current and next generation vehicles may include those with a fully automated guidance systems, semi-automated guidance and fully manual vehicles. Semi-automated vehicles may include those with advanced driver assistance systems (ADAS) that may be designed to assist drivers avoid accidents. Automated and semi-automated vehicles may include adaptive features that may automate lighting, provide adaptive cruise control, automate braking, incorporate GPS/traffic warnings, connect to smartphones, alert driver to other cars or dangers, keep the driver in the correct lane, show what is in blind spots and other features. Infrastructure may increasingly become more intelligent by including systems to help vehicles move more safely and efficiently such as installing sensors, communication devices and other systems. Over the next several decades, vehicles of all types, manual, semi-automated and automated, may operate on the same roads and may need operate cooperatively and synchronously for safety and efficiency.

SUMMARY

This disclosure is directed to a system that implements techniques for determining quality metrics of infrastructure articles. For example, infrastructure articles may include messages (human- and/or machine-readable), colors, retroreflective properties, and/or other visual indicia. The quality of infrastructure articles may deteriorate over time due to weather, light exposure, or other causes, or the quality of infrastructure articles may be affected by an event, such as removal of infrastructure articles, damage caused by physical impacts to infrastructure articles, or other causes. In some instances, infrastructure quality may be difficult and/or time-consuming to measure, and as such, custodians of infrastructure articles and/or users of infrastructure articles may not have awareness of deficiencies in infrastructure quality. Because deficiencies in infrastructure quality can pose safety concerns for human- and machine-operated vehicles, determining infrastructure quality metrics as described in this disclosure may improve the safety of infrastructure articles and pathways associated with the infrastructure articles. Rather than a human visually inspecting an infrastructure article to make a qualitative evaluation of the article, techniques of this disclosure may receive different sets of infrastructure data for a particular infrastructure article that is proximate to each respective vehicle of the set of vehicles. Each respective vehicle in the set of vehicles may include at least one infrastructure sensor that generates infrastructure data descriptive of infrastructure articles that are proximate to the respective vehicle. Techniques of this disclosure may determine, based at least in part on the different sets of infrastructure data for the particular infrastructure article from each respective vehicle of the set of vehicles, a quality metric for the infrastructure article, and perform at least one operation based at least in part on the quality metric for the infrastructure article. By collecting and analyzing set of infrastructure data from multiple vehicles that relate to the infrastructure article, techniques of this disclosure may make determinations about the quality of the infrastructure article with higher confidence levels than conventional techniques. Higher-confidence determinations may improve safety by identifying and generating notifications to replace infrastructure articles when quality becomes deficient and human- and machine-driven vehicles may receive information based on quality of the infrastructure article that is usable to determine how reliable the infrastructure article is when controlling a vehicle. In this way, techniques of the disclosure may improve the safety for the pathway associated with infrastructure article and/or vehicles which operate on the pathway.

In some examples, a computing device may include one or more computer processors, a communication device, and a memory comprising instructions that when executed by the one or more computer processors cause the one or more computer processors to: receive, using the communication device and from a set of vehicles, different sets of infrastructure data for a particular infrastructure article that is proximate to each respective vehicle of the set of vehicles, wherein each respective vehicle in the set of vehicles comprises at least one infrastructure sensor that generates infrastructure data descriptive of infrastructure articles that are proximate to the respective vehicle; determine, based at least in part on the different sets of infrastructure data for the particular infrastructure article from each respective vehicle of the set of vehicles, a quality metric for the infrastructure article; and perform at least one operation based at least in part on the quality metric for the infrastructure article.

The details of one or more examples of the disclosure are set forth in the accompanying drawings and the description below. Other features, objects, and advantages of the disclosure will be apparent from the description and drawings, and from the claims.

DETAILED DESCRIPTION

Figure 1:
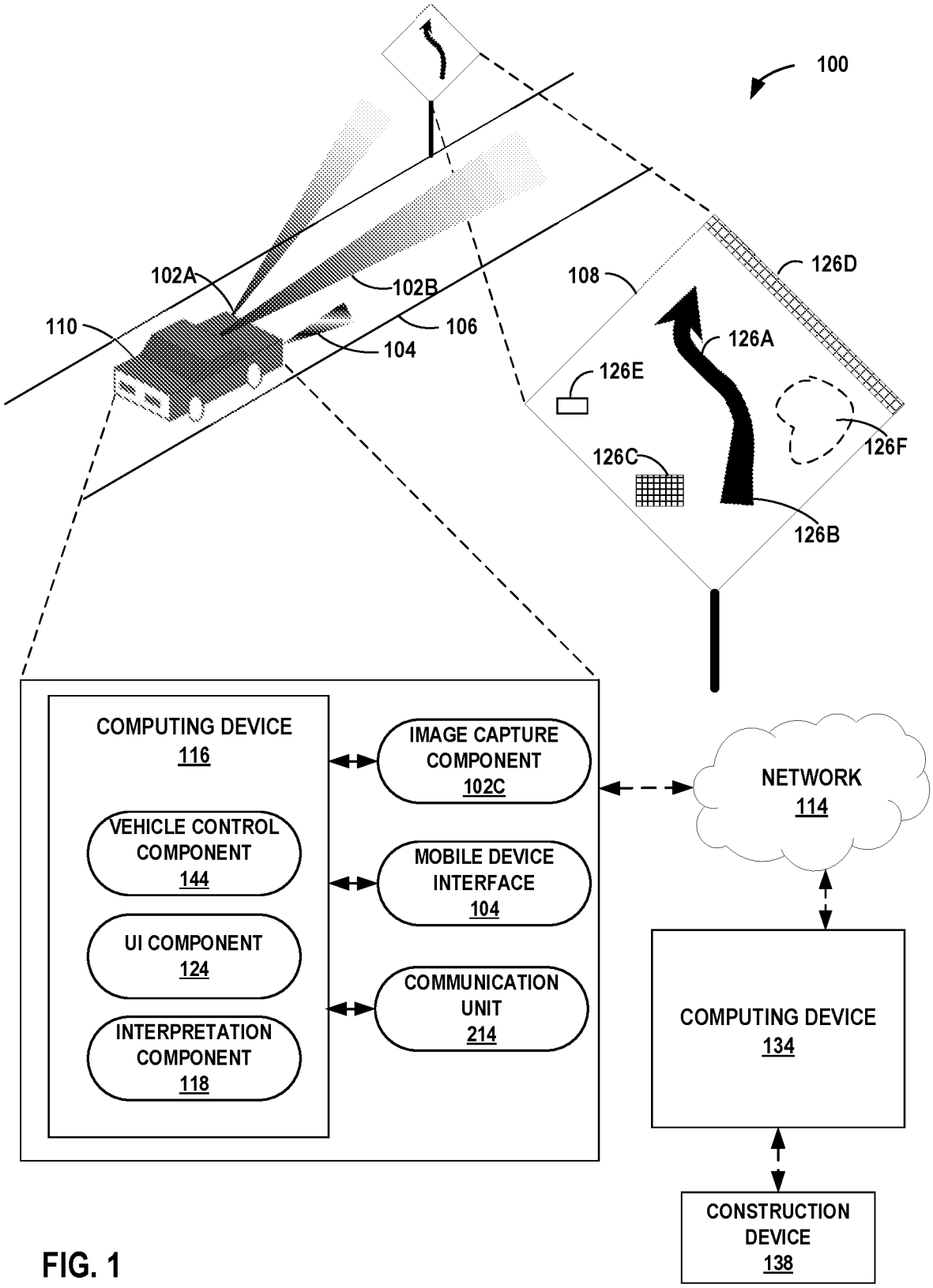
FIG. 1 is a block diagram illustrating an example system with an enhanced sign that is configured to be interpreted by a PAAV in accordance with techniques of this disclosure.

Even with advances in autonomous driving technology, infrastructure, including vehicle roadways, may have a long transition period during which fully pathway-article assisted vehicles (PAAVs), vehicles with advanced Automated Driver Assist Systems (ADAS), and traditional fully human operated vehicles share the road. Some practical constraints may make this transition period decades long, such as the service life of vehicles currently on the road, the capital invested in current infrastructure and the cost of replacement, and the time to manufacture, distribute, and install fully autonomous vehicles and infrastructure.

Autonomous vehicles and ADAS, which may be referred to as semi-autonomous vehicles, may use various sensors to perceive the environment, infrastructure, and other objects around the vehicle. Examples of sensors (or "infrastructure sensors") may include but are not limited to one or more of image sensor, LiDAR, acoustic, radar, GPS location of infrastructure article, time sensor for detection time of infrastructure article, weather sensor for weather measurement at the time infrastructure article is detected. These various sensors combined with onboard computer processing may allow the automated system to perceive complex information and respond to it more quickly than a human driver. In this disclosure, a vehicle may include any vehicle with or without sensors, such as a vision system, to interpret a vehicle pathway. A vehicle with vision systems or other sensors that takes cues from the vehicle pathway may be called a pathway-article assisted vehicle (PAAV). Some examples of PAAVs may include the fully autonomous vehicles and ADAS equipped vehicles mentioned above, as well as unmanned aerial vehicles (UAV) (aka drones), human flight transport devices, underground pit mining ore carrying vehicles, forklifts, factory part or tool transport vehicles, ships and other watercraft and similar vehicles. A vehicle pathway may be a road, highway, a warehouse aisle, factory floor or a pathway not connected to the earth's surface. The vehicle pathway may include portions not limited to the pathway itself. In the example of a road, the pathway may include the road shoulder, physical structures near the pathway such as toll booths, railroad crossing equipment, traffic lights, the sides of a mountain, guardrails, and generally encompassing any other properties or characteristics of the pathway or objects/structures in proximity to the pathway. This will be described in more detail below.

A pathway article may include an article message on the physical surface of the pathway article. In this disclosure, an article message may include images, graphics, characters, such as numbers or letters or any combination of characters, symbols or non-characters. An article message may include human-perceptible information and machine-perceptible information. Human-perceptible information may include information that indicates one or more first characteristics of a vehicle pathway primary information, such as information typically intended to be interpreted by human drivers. In other words, the human-perceptible information may provide a human-perceptible representation that is descriptive of at least a portion of the vehicle pathway. As described herein, human-perceptible information may generally refer to information that indicates a general characteristic of a vehicle pathway and that is intended to be interpreted by a human driver. For example, the human-perceptible information may include words (e.g., "dead end" or the like), symbols or graphics (e.g., an arrow indicating the road ahead includes a sharp turn). Human-perceptible information may include the color of the article message or other features of the pathway article, such as the border or background color. For example, some background colors may indicate information only, such as "scenic overlook" while other colors may indicate a potential hazard.

In some instances, the human-perceptible information may correspond to words or graphics included in a specification. For example, in the United States (U.S.), the human-perceptible information may correspond to words or symbols included in the Manual on Uniform Traffic Control Devices (MUTCD), which is published by the U.S. Department of Transportation (DOT) and includes specifications for many conventional signs for roadways. Other countries have similar specifications for traffic control symbols and devices. In some examples, the human-perceptible information may be referred to as primary information.

In some examples, an enhanced sign may also include second, additional information that may be interpreted by a PAAV. As described herein, second information or machine-perceptible information may generally refer to additional detailed characteristics of the vehicle pathway. The machine-perceptible information is configured to be interpreted by a PAAV, but in some examples, may be interpreted by a human driver. In other words, machine-perceptible information may include a feature of the graphical symbol that is a computer-interpretable visual property of the graphical symbol. In some examples, the machine-perceptible information may relate to the human-perceptible information, e.g., provide additional context for the human-perceptible information. In an example of an arrow indicating a sharp turn, the human-perceptible information may be a general representation of an arrow, while the machine-perceptible information may provide an indication of the particular shape of the turn including the turn radius, any incline of the roadway, a distance from the sign to the turn, or the like. The additional information may be visible to a human operator; however, the additional information may not be readily interpretable by the human operator, particularly at speed. In other examples, the additional information may not be visible to a human operator, but may still be machine readable and visible to a vision system of a PAAV. In some examples, an enhanced sign may be considered an optically active article.

Redundancy and security may be of concern for a partially and fully autonomous vehicle infrastructure. A blank highway approach to an autonomous infrastructure, i.e. one in which there is no signage or markings on the road and all vehicles are controlled by information from the cloud, may be susceptible to hackers, terroristic ill intent, and unintentional human error. For example, GPS signals can be spoofed to interfere with drone and aircraft navigation. The techniques of this disclosure provide local, onboard redundant validation of information received from GPS and the cloud. The pathway articles of this disclosure may provide additional information to autonomous systems in a manner which is at least partially perceptible by human drivers. Therefore, the techniques of this disclosure may provide solutions that may support the long-term transition to a fully autonomous infrastructure because it can be implemented in high impact areas first and expanded to other areas as budgets and technology allow.

Hence, pathway articles of this disclosure, such as an enhanced sign, may provide additional information that may be processed by the onboard computing systems of the vehicle, along with information from the other sensors on the vehicle that are interpreting the vehicle pathway. The pathway articles of this disclosure may also have advantages in applications such as for vehicles operating in warehouses, factories, airports, airways, waterways, underground or pit mines and similar locations.

FIG. 1 is a block diagram illustrating an example system 100 with an enhanced sign that is configured to be interpreted by a PAAV in accordance with techniques of this disclosure. As described herein, PAAV generally refers to a vehicle with a vision system, along with other sensors, that may interpret the vehicle pathway and the vehicle's environment, such as other vehicles or objects. A PAAV may interpret information from the vision system and other sensors, make decisions and take actions to navigate the vehicle pathway.

As shown in FIG. 1, system 100 includes PAAV 110 that may operate on vehicle pathway 106 and that includes image capture devices 102A and 102B and computing device 116. Any number of image capture devices may be possible. The illustrated example of system 100 also includes one or more pathway articles as described in this disclosure, such as enhanced sign 108.

As noted above, PAAV 110 of system 100 may be an autonomous or semi-autonomous vehicle, such as an ADAS. In some examples PAAV 110 may include occupants that may take full or partial control of PAAV 110. PAAV 110 may be any type of vehicle designed to carry passengers or freight including small electric powered vehicles, large trucks or lorries with trailers, vehicles designed to carry crushed ore within an underground mine, or similar types of vehicles. PAAV 110 may include lighting, such as headlights in the visible light spectrum as well as light sources in other spectrums, such as infrared. PAAV 110 may include other sensors such as radar, sonar, lidar, GPS and communication links for the purpose of sensing the vehicle pathway, other vehicles in the vicinity, environmental conditions around the vehicle and communicating with infrastructure. For example, a rain sensor may operate the vehicles windshield wipers automatically in response to the amount of precipitation, and may also provide inputs to the onboard computing device 116.

As shown in FIG. 1, PAAV 110 of system 100 may include image capture devices 102A and 102B, collectively referred to as image capture devices 102. Image capture devices 102 may convert light or electromagnetic radiation sensed by one or more image capture sensors into information, such as digital image or bitmap comprising a set of pixels. Each pixel may have chrominance and/or luminance components that represent the intensity and/or color of light or electromagnetic radiation. In general, image capture devices 102 may be used to gather information about a pathway. Image capture devices 102 may send image capture information to computing device 116 via image capture component 102C. Image capture devices 102 may capture lane markings, centerline markings, edge of roadway or shoulder markings, as well as the general shape of the vehicle pathway. The general shape of a vehicle pathway may include turns, curves, incline, decline, widening, narrowing or other characteristics. Image capture devices 102 may have a fixed field of view or may have an adjustable field of view. An image capture device with an adjustable field of view may be configured to pan left and right, up and down relative to PAAV 110 as well as be able to widen or narrow focus. In some examples, image capture devices 102 may include a first lens and a second lens.

Image capture devices 102 may include one or more image capture sensors and one or more light sources. In some examples, image capture devices 102 may include image capture sensors and light sources in a single integrated device. In other examples, image capture sensors or light sources may be separate from or otherwise not integrated in image capture devices 102. As described above, PAAV 110 may include light sources separate from image capture devices 102. Examples of image capture sensors within image capture devices 102 may include semiconductor charge-coupled devices (CCD) or active pixel sensors in complementary metal-oxide-semiconductor (CMOS) or N-type metal-oxide-semiconductor (NMOS, Live MOS) technologies. Digital sensors include flat panel detectors. In one example, image capture devices 102 includes at least two different sensors for detecting light in two different wavelength spectrums.

In some examples, one or more light sources 104 include a first source of radiation and a second source of radiation. In some embodiments, the first source of radiation emits radiation in the visible spectrum, and the second source of radiation emits radiation in the near infrared spectrum. In other embodiments, the first source of radiation and the second source of radiation emit radiation in the near infrared spectrum. As shown in FIG. 1 one or more light sources 104 may emit radiation in the near infrared spectrum.

In some examples, image capture devices 102 captures frames at 50 frames per second (fps). Other examples of frame capture rates include 60, 30 and 25 fps. It should be apparent to a skilled artisan that frame capture rates are dependent on application and different rates may be used, such as, for example, 100 or 200 fps. Factors that affect required frame rate are, for example, size of the field of view (e.g., lower frame rates can be used for larger fields of view, but may limit depth of focus), and vehicle speed (higher speed may require a higher frame rate).

In some examples, image capture devices 102 may include at least more than one channel. The channels may be optical channels. The two optical channels may pass through one lens onto a single sensor. In some examples, image capture devices 102 includes at least one sensor, one lens and one band pass filter per channel. The band pass filter permits the transmission of multiple near infrared wavelengths to be received by the single sensor. The at least two channels may be differentiated by one of the following: (a) width of band (e.g., narrowband or wideband, wherein narrowband illumination may be any wavelength from the visible into the near infrared); (b) different wavelengths (e.g., narrowband processing at different wavelengths can be used to enhance features of interest, such as, for example, an enhanced sign of this disclosure, while suppressing other features (e.g., other objects, sunlight, headlights); (c) wavelength region (e.g., broadband light in the visible spectrum and used with either color or monochrome sensors); (d) sensor type or characteristics; (e) time exposure; and (f) optical components (e.g., lensing).

In some examples, image capture devices 102A and 102B may include an adjustable focus function. For example, image capture device 102B may have a wide field of focus that captures images along the length of vehicle pathway 106, as shown in the example of FIG. 1. Computing device 116 may control image capture device 102A to shift to one side or the other of vehicle pathway 106 and narrow focus to capture the image of enhanced sign 108, or other features along vehicle pathway 106. The adjustable focus may be physical, such as adjusting a lens focus, or may be digital, similar to the facial focus function found on desktop conferencing cameras. In the example of FIG. 1, image capture devices 102 may be communicatively coupled to computing device 116 via image capture component 102C. Image capture component 102C may receive image information from the plurality of image capture devices, such as image capture devices 102, perform image processing, such as filtering, amplification and the like, and send image information to computing device 116.

Other components of PAAV 110 that may communicate with computing device 116 may include image capture component 102C, described above, mobile device interface 104, and communication unit 214. In some examples image capture component 102C, mobile device interface 104, and communication unit 214 may be separate from computing device 116 and in other examples may be a component of computing device 116.

Mobile device interface 104 may include a wired or wireless connection to a smartphone, tablet computer, laptop computer or similar device. In some examples, computing device 116 may communicate via mobile device interface 104 for a variety of purposes such as receiving traffic information, address of a desired destination or other purposes. In some examples computing device 116 may communicate to external networks 114, e.g. the cloud, via mobile device interface 104. In other examples, computing device 116 may communicate via communication units 214.

One or more communication units 214 of computing device 116 may communicate with external devices by transmitting and/or receiving data. For example, computing device 116 may use communication units 214 to transmit and/or receive radio signals on a radio network such as a cellular radio network or other networks, such as networks 114. In some examples communication units 214 may transmit and receive messages and information to other vehicles, such as information interpreted from enhanced sign 108. In some examples, communication units 214 may transmit and/or receive satellite signals on a satellite network such as a Global Positioning System (GPS) network.

In the example of FIG. 1, computing device 116 includes vehicle control component 144 and user interface (UI) component 124 and an interpretation component 118. Components 118, 144, and 124 may perform operations described herein using software, hardware, firmware, or a mixture of both hardware, software, and firmware residing in and executing on computing device 116 and/or at one or more other remote computing devices. In some examples, components 118, 144 and 124 may be implemented as hardware, software, and/or a combination of hardware and software.

Computing device 116 may execute components 118, 124, 144 with one or more processors. Computing device 116 may execute any of components 118, 124, 144 as or within a virtual machine executing on underlying hardware. Components 118, 124, 144 may be implemented in various ways. For example, any of components 118, 124, 144 may be implemented as a downloadable or pre-installed application or "app." In another example, any of components 118, 124, 144 may be implemented as part of an operating system of computing device 116. Computing device 116 may include inputs from sensors not shown in FIG. 1 such as engine temperature sensor, speed sensor, tire pressure sensor, air temperature sensors, an inclinometer, accelerometers, light sensor, and similar sensing components.

UI component 124 may include any hardware or software for communicating with a user of PAAV 110. In some examples, UI component 124 includes outputs to a user such as displays, such as a display screen, indicator or other lights, audio devices to generate notifications or other audible functions. UI component 24 may also include inputs such as knobs, switches, keyboards, touch screens or similar types of input devices.

Vehicle control component 144 may include for example, any circuitry or other hardware, or software that may adjust one or more functions of the vehicle. Some examples include adjustments to change a speed of the vehicle, change the status of a headlight, changing a damping coefficient of a suspension system of the vehicle, apply a force to a steering system of the vehicle or change the interpretation of one or more inputs from other sensors. For example, an IR capture device may determine an object near the vehicle pathway has body heat and change the interpretation of a visible spectrum image capture device from the object being a non-mobile structure to a possible large animal that could move into the pathway. Vehicle control component 144 may further control the vehicle speed as a result of these changes. In some examples, the computing device initiates the determined adjustment for one or more functions of the PAAV based on the machine-perceptible information in conjunction with a human operator that alters one or more functions of the PAAV based on the human-perceptible information.

Interpretation component 118 may receive infrastructure information about vehicle pathway 106 and determine one or more characteristics of vehicle pathway 106. For example, interpretation component 118 may receive images from image capture devices 102 and/or other information from systems of PAAV 110 in order to make determinations about characteristics of vehicle pathway 106. As described below, in some examples, interpretation component 118 may transmit such determinations to vehicle control component 144, which may control PAAV 110 based on the information received from interpretation component. In other examples, computing device 116 may use information from interpretation component 118 to generate notifications for a user of PAAV 110, e.g., notifications that indicate a characteristic or condition of vehicle pathway 106.

Enhanced sign 108 represents one example of a pathway article and may include reflective, non-reflective, and/or retroreflective sheet applied to a base surface. An article message, such as but not limited to characters, images, and/or any other information, may be printed, formed, or otherwise embodied on the enhanced sign 108. The reflective, non-reflective, and/or retroreflective sheet may be applied to a base surface using one or more techniques and/or materials including but not limited to: mechanical bonding, thermal bonding, chemical bonding, or any other suitable technique for attaching retroreflective sheet to a base surface. A base surface may include any surface of an object (such as described above, e.g., an aluminum plate) to which the reflective, non-reflective, and/or retroreflective sheet may be attached. An article message may be printed, formed, or otherwise embodied on the sheeting using any one or more of an ink, a dye, a thermal transfer ribbon, a colorant, a pigment, and/or an adhesive coated film. In some examples, content is formed from or includes a multi-layer optical film, a material including an optically active pigment or dye, or an optically active pigment or dye.

Enhanced sign 108 in FIG. 1 includes article message 126A-126F (collectively "article message 126"). Article message 126 may include a plurality of components or features that provide information on one or more characteristics of a vehicle pathway. Article message 126 may include primary information (interchangeably referred to herein as human-perceptible information) that indicates general information about vehicle pathway 106. Article message 126 may include additional information (interchangeably referred to herein as machine-perceptible information) that may be configured to be interpreted by a PAAV.

In the example of FIG. 1, one component of article message 126 includes arrow 126A, a graphical symbol. The general contour of arrow 126A may represent primary information that describes a characteristic of vehicle pathway 106, such as an impending curve. For example, features arrow 126A may include the general contour of arrow 126A and may be interpreted by both a human operator of PAAV 110 as well as computing device 116 onboard PAAV 110.

In some examples, according to aspects of this disclosure, article message 126 may include a machine readable fiducial marker 126C. The fiducial marker may also be referred to as a fiducial tag. Fiducial tag 126C may represent additional information about characteristics of pathway 106, such as the radius of the impending curve indicated by arrow 126A or a scale factor for the shape of arrow 126A. In some examples, fiducial tag 126C may indicate to computing device 116 that enhanced sign 108 is an enhanced sign rather than a conventional sign. In other examples, fiducial tag 126C may act as a security element that indicates enhanced sign 108 is not a counterfeit.

In other examples, other portions of article message 126 may indicate to computing device 116 that a pathway article is an enhanced sign. For example, according to aspects of this disclosure, article message 126 may include a change in polarization in area 126F. In this example, computing device 116 may identify the change in polarization and determine that article message 126 includes additional information regarding vehicle pathway 106.

In accordance with techniques of this disclosure, enhanced sign 108 further includes article message components such as one or more security elements 126E, separate from fiducial tag 126C. In some examples, security elements 126E may be any portion of article message 126 that is printed, formed, or otherwise embodied on enhanced sign 108 that facilitates the detection of counterfeit pathway articles.

Enhanced sign 108 may also include the additional information that represent characteristics of vehicle pathway 106 that may be printed, or otherwise disposed in locations that do not interfere with the graphical symbols, such as arrow 126A. For example, border information 126D may include additional information such as number of curves to the left and right, the radius of each curve and the distance between each curve. The example of FIG. 1 depicts border information 126D as along a top border of enhanced sign 108. In other examples, border information 126D may be placed along a partial border, or along two or more borders.

Similarly, enhanced sign 108 may include components of article message 126 that do not interfere with the graphical symbols by placing the additional machine readable information so it is detectable outside the visible light spectrum, such as area 126F. As described above in relation to fiducial tag 126C, thickened portion 126B, border information 126D, area 126F may include detailed information about additional characteristics of vehicle pathway 106 or any other information.

As described above for area 126F, some components of article message 126 may only be detectable outside the visible light spectrum. This may have advantages of avoiding interfering with a human operator interpreting enhanced sign 108, providing additional security. The non-visible components of article message 126 may include area 126F, security elements 126E and fiducial tag 126C.

Non-visible components in FIG. 1 are described for illustration purposes as being formed by different areas that either retroreflect or do not retroreflect light, non-visible components in FIG. 1 may be printed, formed, or otherwise embodied in a pathway article using any light reflecting technique in which information may be determined from non-visible components. For instance, non-visible components may be printed using visibly-opaque, infrared-transparent ink and/or visibly-opaque, infrared-opaque ink. In some examples, non-visible components may be placed on enhanced sign 108 by employing polarization techniques, such as right circular polarization, left circular polarization or similar techniques.

According to aspects of this disclosure, in operation, interpretation component 118 may receive an image of enhanced sign 108 via image capture component 102C and interpret information from article message 126. For example, interpretation component 118 may interpret fiducial tag 126C and determine that (a) enhanced sign 108 contains additional, machine readable information and (b) that enhanced sign 108 is not counterfeit.

Interpretation unit 118 may determine one or more characteristics of vehicle pathway 106 from the primary information as well as the additional information. In other words, interpretation unit 118 may determine first characteristics of the vehicle pathway from the human-perceptible information on the pathway article, and determine second characteristics from the machine-perceptible information. For example, interpretation unit 118 may determine physical properties, such as the approximate shape of an impending set of curves in vehicle pathway 106 by interpreting the shape of arrow 126A. The shape of arrow 126A defining the approximate shape of the impending set of curves may be considered the primary information. The shape of arrow 126A may also be interpreted by a human occupant of PAAV 110.

Interpretation component 118 may also determine additional characteristics of vehicle pathway 106 by interpreting other machine-readable portions of article message 126. For example, by interpreting border information 126D and/or area 126F, interpretation component 118 may determine vehicle pathway 106 includes an incline along with a set of curves. Interpretation component 118 may signal computing device 116, which may cause vehicle control component 144 to prepare to increase power to maintain speed up the incline. Additional information from article message 126 may cause additional adjustments to one or more functions of PAAV 110. Interpretation component 118 may determine other characteristics, such as a change in road surface. Computing device 116 may determine characteristics of vehicle pathway 106 require a change to the vehicle suspension settings and cause vehicle control component 144 to perform the suspension setting adjustment. In some examples, interpretation component 118 may receive information on the relative position of lane markings to PAAV 110 and send signals to computing device 116 that cause vehicle control component 144 to apply a force to the steering to center PAAV 110 between the lane markings.

The pathway article of this disclosure is just one piece of additional information that computing device 116, or a human operator, may consider when operating a vehicle. Other information may include information from other sensors, such as radar or ultrasound distance sensors, wireless communications with other vehicles, lane markings on the vehicle pathway captured from image capture devices 102, information from GPS, and the like. Computing device 116 may consider the various inputs (p) and consider each with a weighting value, such as in a decision equation, as local information to improve the decision process. One possible decision equation may include:

$$D=w1*p1+w2*p2+\ldots wn*pn+wES*pES$$

where the weights (w1-wn) may be a function of the information received from the enhanced sign (pES). In the example of a construction zone, an enhanced sign may indicate a lane shift from the construction zone. Therefore, computing device 116 may de-prioritize signals from lane marking detection systems when operating the vehicle in the construction zone.

In some examples, PAAV 110 may be a test vehicle that may determine one or more characteristics of vehicle pathway 106 and may include additional sensors as well as components to communicate to a construction device such as construction device 138. As a test vehicle, PAAV 110 may be autonomous, remotely controlled, semi-autonomous or manually controlled. One example application may be to determine a change in vehicle pathway 106 near a construction zone. Once the construction zone workers mark the change with barriers, traffic cones or similar markings, PAAV 110 may traverse the changed pathway to determine characteristics of the pathway. Some examples may include a lane shift, closed lanes, detour to an alternate route and similar changes. The computing device onboard the test device, such as computing device 116 onboard PAAV 110, may assemble the characteristics of the vehicle pathway into data that contains the characteristics, or attributes, of the vehicle pathway.

Computing device 134 may receive a printing specification that defines one or more properties of the pathway article, such as enhanced sign 108. For example, computing device 134 may receive printing specification information included in the MUTCD from the U.S. DOT, or similar regulatory information found in other countries, that define the requirements for size, color, shape and other properties of pathway articles used on vehicle pathways. A printing specification may also include properties of manufacturing the barrier layer, retroreflective properties and other information that may be used to generate a pathway article. Machine-perceptible information may also include a confidence level of the accuracy of the machine-perceptible information. For example, a pathway marked out by a drone may not be as accurate as a pathway marked out by a test vehicle. Therefore, the dimensions of a radius of curvature, for example, may have a different confidence level based on the source of the data. The confidence level may impact the weighting of the decision equation described above.

Computing device 134 may generate construction data to form the article message on an optically active device, which will be described in more detail below. The construction data may be a combination of the printing specification and the characteristics of the vehicle pathway. Construction data generated by computing device 134 may cause construction device 138 to dispose the article message on a substrate in accordance with the printing specification and the data that indicates at least one characteristic of the vehicle pathway.

Figure 5:
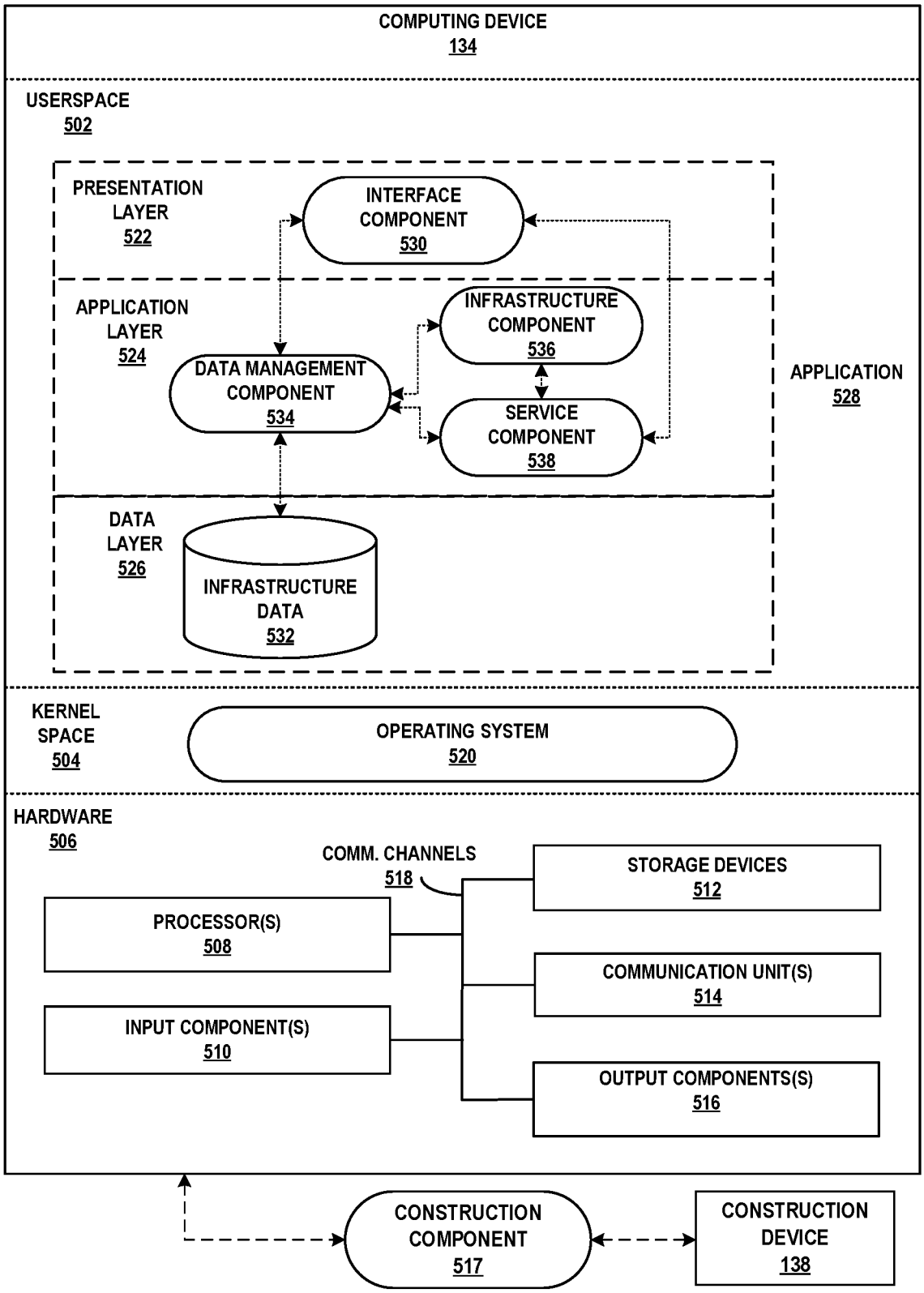
FIG. 5 is a block diagram illustrating an example computing device, in accordance with one or more aspects of the present disclosure.

As further described in FIG. 5, computing device 134 may implement techniques of this disclosure to determine infrastructure quality metrics. For example, computing device 134 may receive, using a communication device and from a set of vehicles (e.g., including vehicle 110), different sets of infrastructure data for a particular infrastructure article 108 that is proximate to each respective vehicle of the set of vehicles. Each respective vehicle in the set of vehicles may include at least one infrastructure sensor that generates infrastructure data descriptive of infrastructure articles that are proximate to the respective vehicle. As further described in this disclosure, computing device 134 may determine, based at least in part on the different sets of infrastructure data for the particular infrastructure article from each respective vehicle of the set of vehicles, a quality metric for the infrastructure article, and perform at least one operation based at least in part on the quality metric for the infrastructure article. Various operations are described in this disclosure.

By collecting and analyzing set of infrastructure data from multiple vehicles that relate to the infrastructure article, techniques of this disclosure may make determinations about the quality of the infrastructure article with higher confidence levels than conventional techniques. Higher-confidence determinations may improve safety by identifying and generating notifications to replace infrastructure articles when quality becomes deficient and human- and machine-driven vehicles may receive information based on quality of the infrastructure article that is usable to determine how reliable the infrastructure article is when controlling a vehicle. In this way, techniques of the disclosure may improve the safety for the pathway associated with infrastructure article and/or vehicles which operate on the pathway.

Figure 2:
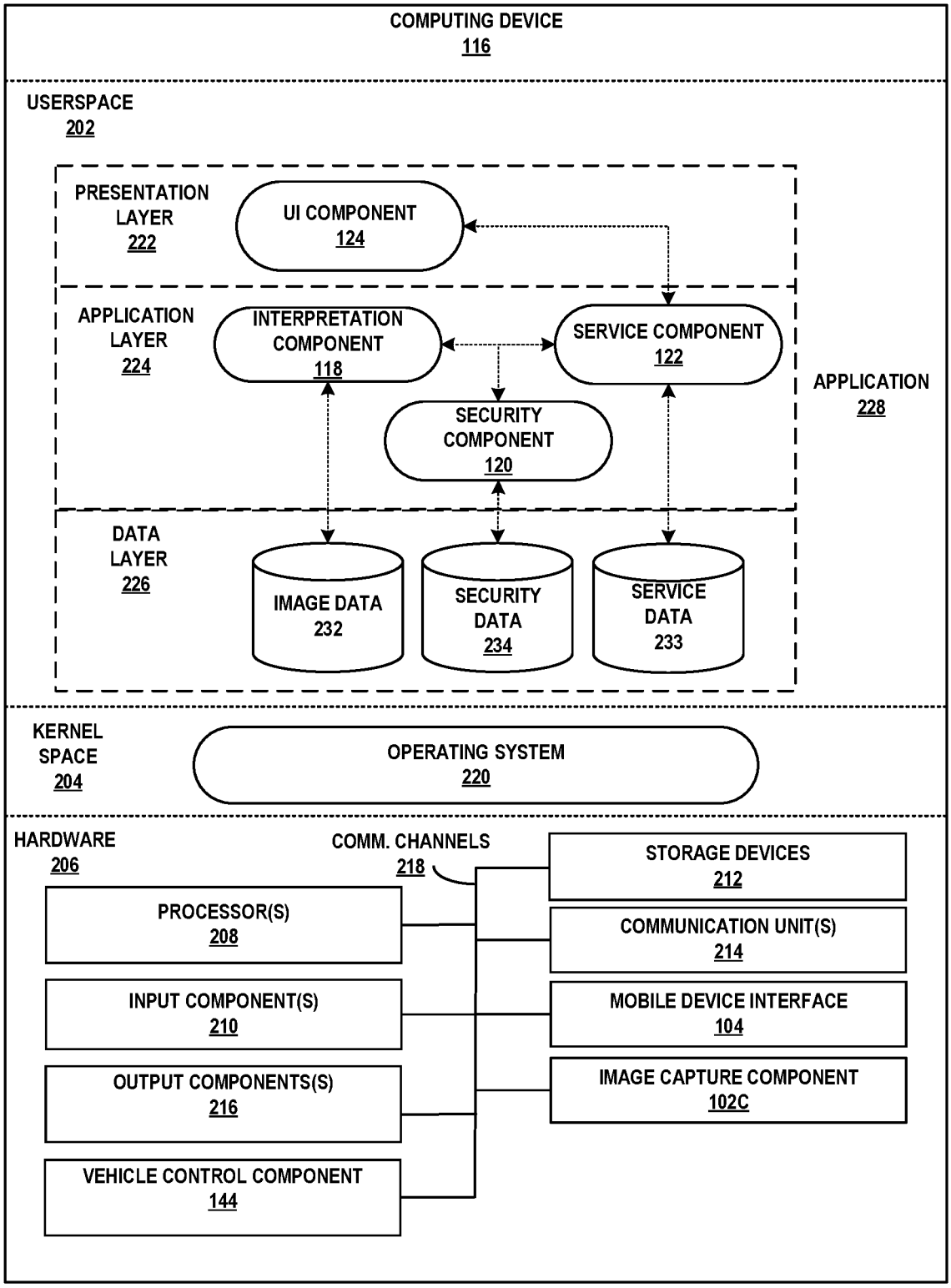
FIG. 2 is a block diagram illustrating an example computing device, in accordance with one or more aspects of the present disclosure.

FIG. 2 is a block diagram illustrating an example computing device, in accordance with one or more aspects of the present disclosure. FIG. 2 illustrates only one example of a computing device. Many other examples of computing device 116 may be used in other instances and may include a subset of the components included in example computing device 116 or may include additional components not shown example computing device 116 in FIG. 2.

In some examples, computing device 116 may be a server, tablet computing device, smartphone, wrist- or head-worn computing device, laptop, desktop computing device, or any other computing device that may run a set, subset, or superset of functionality included in application 228. In some examples, computing device 116 may correspond to vehicle computing device 116 onboard PAAV 110, depicted in FIG. 1. In other examples, computing device 116 may also be part of a system or device that produces signs and correspond to computing device 134 depicted in FIG. 1.

As shown in the example of FIG. 2, computing device 116 may be logically divided into user space 202, kernel space 204, and hardware 206. Hardware 206 may include one or more hardware components that provide an operating environment for components executing in user space 202 and kernel space 204. User space 202 and kernel space 204 may represent different sections or segmentations of memory, where kernel space 204 provides higher privileges to processes and threads than user space 202. For instance, kernel space 204 may include operating system 220, which operates with higher privileges than components executing in user space 202. In some examples, any components, functions, operations, and/or data may be included or executed in kernel space 204 and/or implemented as hardware components in hardware 206.

As shown in FIG. 2, hardware 206 includes one or more processors 208, input components 210, storage devices 212, communication units 214, output components 216, mobile device interface 104, image capture component 102C, and vehicle control component 144. Processors 208, input components 210, storage devices 212, communication units 214, output components 216, mobile device interface 104, image capture component 102C, and vehicle control component 144 may each be interconnected by one or more communication channels 218. Communication channels 218 may interconnect each of the components 102C, 104, 208, 210, 212, 214, 216, and 144 for inter-component communications (physically, communicatively, and/or operatively). In some examples, communication channels 218 may include a hardware bus, a network connection, one or more inter-process communication data structures, or any other components for communicating data between hardware and/or software.

One or more processors 208 may implement functionality and/or execute instructions within computing device 116. For example, processors 208 on computing device 116 may receive and execute instructions stored by storage devices 212 that provide the functionality of components included in kernel space 204 and user space 202. These instructions executed by processors 208 may cause computing device 116 to store and/or modify information, within storage devices 212 during program execution. Processors 208 may execute instructions of components in kernel space 204 and user space 202 to perform one or more operations in accordance with techniques of this disclosure. That is, components included in user space 202 and kernel space 204 may be operable by processors 208 to perform various functions described herein.

One or more input components 210 of computing device 116 may receive input. Examples of input are tactile, audio, kinetic, and optical input, to name only a few examples. Input components 210 of computing device 116, in one example, include a mouse, keyboard, voice responsive system, video camera, buttons, control pad, microphone or any other type of device for detecting input from a human or machine. In some examples, input component 210 may be a presence-sensitive input component, which may include a presence-sensitive screen, touch-sensitive screen, etc.

One or more communication units 214 of computing device 116 may communicate with external devices by transmitting and/or receiving data. For example, computing device 116 may use communication units 214 to transmit and/or receive radio signals on a radio network such as a cellular radio network. In some examples, communication units 214 may transmit and/or receive satellite signals on a satellite network such as a Global Positioning System (GPS) network. Examples of communication units 214 include a network interface card (e.g. such as an Ethernet card), an optical transceiver, a radio frequency transceiver, a GPS receiver, or any other type of device that can send and/or receive information. Other examples of communication units 214 may include Bluetooth®, GPS, 3G, 4G, and Wi-Fi® radios found in mobile devices as well as Universal Serial Bus (USB) controllers and the like.

In some examples, communication units 214 may receive data that includes one or more characteristics of a vehicle pathway. In examples where computing device 116 is part of a vehicle, such as PAAV 110 depicted in FIG. 1, communication units 214 may receive information about a pathway article from an image capture device, as described in relation to FIG. 1. In other examples, such as examples where computing device 116 is part of a system or device that produces signs, communication units 214 may receive data from a test vehicle, handheld device or other means that may gather data that indicates the characteristics of a vehicle pathway, as described above in FIG. 1 and in more detail below. Computing device 116 may receive updated information, upgrades to software, firmware and similar updates via communication units 214.

One or more output components 216 of computing device 116 may generate output. Examples of output are tactile, audio, and video output. Output components 216 of computing device 116, in some examples, include a presence-sensitive screen, sound card, video graphics adapter card, speaker, cathode ray tube (CRT) monitor, liquid crystal display (LCD), or any other type of device for generating output to a human or machine. Output components may include display components such as cathode ray tube (CRT) monitor, liquid crystal display (LCD), Light-Emitting Diode (LED) or any other type of device for generating tactile, audio, and/or visual output. Output components 216 may be integrated with computing device 116 in some examples.

In other examples, output components 216 may be physically external to and separate from computing device 116, but may be operably coupled to computing device 116 via wired or wireless communication. An output component may be a built-in component of computing device 116 located within and physically connected to the external packaging of computing device 116 (e.g., a screen on a mobile phone). In another example, a presence-sensitive display may be an external component of computing device 116 located outside and physically separated from the packaging of computing device 116 (e.g., a monitor, a projector, etc. that shares a wired and/or wireless data path with a tablet computer).

Hardware 206 may also include vehicle control component 144, in examples where computing device 116 is onboard a PAAV. Vehicle control component 144 may have the same or similar functions as vehicle control component 144 described in relation to FIG. 1.

One or more storage devices 212 within computing device 116 may store information for processing during operation of computing device 116. In some examples, storage device 212 is a temporary memory, meaning that a primary purpose of storage device 212 is not long-term storage. Storage devices 212 on computing device 116 may configured for short-term storage of information as volatile memory and therefore not retain stored contents if deactivated. Examples of volatile memories include random access memories (RAM), dynamic random access memories (DRAM), static random access memories (SRAM), and other forms of volatile memories known in the art.

Storage devices 212, in some examples, also include one or more computer-readable storage media. Storage devices 212 may be configured to store larger amounts of information than volatile memory. Storage devices 212 may further be configured for long-term storage of information as non-volatile memory space and retain information after activate/off cycles. Examples of non-volatile memories include magnetic hard discs, optical discs, floppy discs, flash memories, or forms of electrically programmable memories (EPROM) or electrically erasable and programmable (EEPROM) memories. Storage devices 212 may store program instructions and/or data associated with components included in user space 202 and/or kernel space 204.

As shown in FIG. 2, application 228 executes in userspace 202 of computing device 116. Application 228 may be logically divided into presentation layer 222, application layer 224, and data layer 226. Presentation layer 222 may include user interface (UI) component 228, which generates and renders user interfaces of application 228. Application 228 may include, but is not limited to: UI component 124, interpretation component 118, security component 120, and one or more service components 122. For instance, application layer 224 may interpretation component 118, service component 122, and security component 120. Presentation layer 222 may include UI component 124.

Data layer 226 may include one or more datastores. A datastore may store data in structure or unstructured form. Example datastores may be any one or more of a relational database management system, online analytical processing database, table, or any other suitable structure for storing data.

Security data 234 may include data specifying one or more validation functions and/or validation configurations. Service data 233 may include any data to provide and/or resulting from providing a service of service component 122. For instance, service data may include information about pathway articles (e.g., security specifications), user information, or any other information. Image data 232 may include one or more images that are received from one or more image capture devices, such as image capture devices 102 described in relation to FIG. 1. In some examples, the images are bitmaps, Joint Photographic Experts Group images (JPEGs), Portable Network Graphics images (PNGs), or any other suitable graphics file formats.

In the example of FIG. 2, one or more of communication units 214 may receive, from an image capture device, an image of a pathway article that includes an article message, such as article message 126 in FIG. 1. In some examples, UI component 124 or any one or more components of application layer 224 may receive the image of the pathway article and store the image in image data 232.

In response to receiving the image, interpretation component 118 may determine that a pathway article is an enhanced sign, such as enhanced sign 108. The pathway article may include at least one article message that indicates one or more characteristics of a pathway for the PAAV. The article message may include primary, or human-perceptible information that indicates one or more first characteristics of the vehicle pathway. An enhanced sign may also include additional or machine-perceptible information that indicates the one or more additional characteristics of the vehicle pathway. In some examples the additional information may information include one or more of a predicted trajectory, an incline change, a change in width, a change in road surface, a defect in the pathway or other potential hazard, the location of other pathway articles, speed limit change, or any other information. An example of a predicted trajectory may include the shape of the vehicle pathway depicted by arrow 126A in FIG. 1. As described above for area 126F, in some examples the additional information includes machine readable information that is detectable outside the visible light spectrum, such as by IR, a change in polarization or similar techniques.

Interpretation component 118 may determine one or more characteristics of a vehicle pathway and transmit data representative of the characteristics to other components of computing device 116, such as service component 122. Interpretation component 118 may determine the characteristics of the vehicle pathway indicate an adjustment to one or more functions of the vehicle. For example, the enhanced sign may indicate that the vehicle is approaching a construction zone and there is a change to the vehicle pathway. Computing device 116 may combine this information with other information from other sensors, such as image capture devices, GPS information, information from network 114 and similar information to adjust the speed, suspension or other functions of the vehicle through vehicle control component 144.

Similarly, computing device 116 may determine one or more conditions of the vehicle. Vehicle conditions may include a weight of the vehicle, a position of a load within the vehicle, a tire pressure of one or more vehicle tires, transmission setting of the vehicle and a powertrain status of the vehicle. For example, a PAAV with a large powertrain may receive different commands when encountering an incline in the vehicle pathway than a PAAV with a less powerful powertrain (i.e. motor).

Computing device may also determine environmental conditions in a vicinity of the vehicle. Environmental conditions may include air temperature, precipitation level, precipitation type, incline of the vehicle pathway, presence of other vehicles and estimated friction level between the vehicle tires and the vehicle pathway.

Computing device 116 may combine information from vehicle conditions, environmental conditions, interpretation component 118 and other sensors to determine adjustments to the state of one or more functions of the vehicle, such as by operation of vehicle control component 144, which may interoperate with any components and/or data of application 228. For example, interpretation component 118 may determine the vehicle is approaching a curve with a downgrade, based on interpreting an enhanced sign on the vehicle pathway. Computing device 116 may determine one speed for dry conditions and a different speed for wet conditions. Similarly, computing device 116 onboard a heavily loaded freight truck may determine one speed while computing device 116 onboard a sports car may determine a different speed.

In some examples, computing device 116 may determine the condition of the pathway by considering a traction control history of a PAAV. For example, if the traction control system of a PAAV is very active, computing device 116 may determine the friction between the pathway and the vehicle tires is low, such as during a snow storm or sleet.

The pathway articles of this disclosure may include one or more security elements, such as security element 126E depicted in FIG. 1, to help determine if the pathway article is counterfeit. Security is a concern with intelligent infrastructure to minimize the impact of hackers, terrorist activity or crime. For example, a criminal may attempt to redirect an autonomous freight truck to an alternate route to steal the cargo from the truck. An invalid security check may cause computing device 116 to give little or no weight to the information in the sign as part of the decision equation to control a PAAV.

As discussed above, for the machine-readable portions of the article message, the properties of security marks may include but are not limited to location, size, shape, pattern, composition, retroreflective properties, appearance under a given wavelength, or any other spatial characteristic of one or more security marks. Security component 120 may determine whether pathway article, such as enhanced sign 108 is counterfeit based at least in part on determining whether the at least one symbol, such as the graphical symbol, is valid for at least one security element. As described in relation to FIG. 1 security component 120 may include one or more validation functions and/or one or more validation conditions on which the construction of enhanced sign 108 is based. In some examples a fiducial marker, such as fiducial tag 126C may act as a security element. In other examples a pathway article may include one or more security elements such as security element 126E.

In FIG. 2, security component 120 determines, using a validation function based on the validation condition in security data 234, whether the pathway article depicted in FIG. 1 is counterfeit. Security component 120, based on determining that the security elements satisfy the validation configuration, generate data that indicates enhanced sign 108 is authentic (e.g., not a counterfeit). If security elements and the article message in enhanced sign 108 did not satisfy the validation criteria, security component 120 may generate data that indicates pathway article is not authentic (e.g., counterfeit) or that the pathway article is not being read correctly.

A pathway article may not be read correctly because it may be partially occluded or blocked, the image may be distorted or the pathway article is damaged. For example, in heavy snow or fog, or along a hot highway subject to distortion from heat rising from the pathway surface, the image of the pathway article may be distorted. In another example, another vehicle, such as a large truck, or a fallen tree limb may partially obscure the pathway article. The security elements, or other components of the article message, may help determine if an enhanced sign is damaged. If the security elements are damaged or distorted, security component 120 may determine the enhanced sign is invalid.

For some examples of computer vision systems, such as may be part of PAAV 110, the pathway article may be visible in hundreds of frames as the vehicle approaches the enhanced sign. The interpretation of the enhanced sign may not necessarily rely on a single, successful capture image. At a far distance, the system may recognize the enhanced sign. As the vehicle gets closer, the resolution may improve and the confidence in the interpretation of the sign information may increase. The confidence in the interpretation may impact the weighting of the decision equation and the outputs from vehicle control component 144.

Service component 122 may perform one or more operations based on the data generated by security component 120 that indicates whether the pathway article is a counterfeit. Service component 122 may, for example, query service data 233 to retrieve a list of recipients for sending a notification or store information that indicates details of the image of the pathway article (e.g., object to which pathway article is attached, image itself, metadata of image (e.g., time, date, location, etc.)). In response to, for example, determining that the pathway article is a counterfeit, service component 122 may send data to UI component 124 that causes UI component 124 to generate an alert for display. UI component 124 may send data to an output component of output components 216 that causes the output component to display the alert.

Similarly, service component 122, or some other component of computing device 116, may cause a message to be sent through communication units 214 that the pathway article is counterfeit. In some examples the message may be sent to law enforcement, those responsible for maintenance of the vehicle pathway and to other vehicles, such as vehicles nearby the pathway article.

As with other portions of the article message, such as border information 126D and area 126F, in some examples, security component 120 may use both a visible light image captured under visible lighting and an IR light image captured under IR light to determine whether a pathway article is counterfeit. For instance, if counterfeiter places an obstructing material (e.g., opaque, non-reflective, etc.) over a security element to make it appear the opposite of what it is (e.g., make an active element appear inactive or vice versa), then security component 120 may determine from the visible light image that obstructing material has been added the pathway article. Therefore, even if the IR light image includes a valid configuration of security elements (due to the obstructing material at various locations), security component 120 may determine that the visible light image includes the obstructing material and is therefore counterfeit.

In some examples, security component 120 may determine one or more predefined image regions (e.g., stored in security data 234) that correspond to security elements for the pathway article. Security component 120 may inspect one or more of the predefined image regions within the image of the pathway article and determine, based at least in part on one or more pixel values in the predefined image regions, one or more values that represent the validation information.

In some examples, security component 120, when determining, based at least in part on one or more pixel values in the predefined image regions, one or more values that represent the validation information further comprises may further determine one or more values that represent the validation information based at least in part one whether the one or more predefined image regions of security elements are active or inactive. In some examples, security component 120 may determine the validation information that is detectable outside the visible light spectrum from the at least one security element further by determining the validation information based at least in part on at least one of a location, shape, size, pattern, composition of the at least one security element.

In some examples, security component 120 may determine whether the pathway article is counterfeit or otherwise invalid based on whether a combination of one or more symbols of the article message and the validation information represent a valid association. Therefore, an invalid enhanced sign may be from a variety of factors including counterfeit, damage, unreadable because of weather or other causes.

The techniques of this disclosure may have an advantage in that the enhanced signs may be created using current printing technology and interpreted with baseline computer vision systems. The techniques of this disclosure may also provide advantages over barcode or similar systems in that a barcode reader may require a look-up database or "dictionary." Some techniques of this disclosure, such as interpreting the shape of arrow 126A in FIG. 1, may not require a look-up or other decoding to determine one or more characteristics of a vehicle pathway. The techniques of this disclosure include small changes to existing signs that may not change human interpretation, while taking advantage of existing computer vision technology to interpret an article message, such as a graphic symbol. Existing graphic symbols on many conventional signs may not depict the actual trajectory of the vehicle pathway. Graphical symbols on enhanced signs of this disclosure may describe actual pathway information, along with additional machine readable information. In this manner, the techniques of this disclosure may help to ensure that autonomous, semi-autonomous and manually operated vehicles are responding to the same cues. The enhanced signs of this disclosure may also provide redundancy at the pathway level to cloud, GPS and other information received by PAAVs. Also, because the enhanced signs of this disclosure include small changes to existing signs, the techniques of this disclosure may be more likely to receive approval from regulatory bodies that approve signs for vehicle pathways.

Techniques of this disclosure may also have advantages of improved safety over conventional signs. For example, one issue with changes in vehicle pathways, such as a construction zone, is driver uncertainty and confusion over the changes. The uncertainty may cause a driver to brake suddenly, take the incorrect path or some other response. Techniques of this disclosure may ensure human operators have a better understanding of changes to vehicle pathway, along with the autonomous and semi-autonomous vehicles.

This may improve safety, not only for drivers but for the construction workers, in examples of vehicle pathways through construction zones.

In some examples, application 228 and/or vehicle control component 144 may generate, using at least one infrastructure sensor, infrastructure data descriptive of infrastructure articles that are proximate to the vehicle. Application 228 and/or vehicle control component 144 may determine, based at least in part on the infrastructure data, a classification for a type of the infrastructure article. Application 228 and/or vehicle control component 144 may, in response to sending the classification to a remote computing device (e.g., computing device 134), receive an indication that the at least one infrastructure sensor is operating abnormally in comparison to other infrastructure sensors of other vehicle. Application 228 and/or vehicle control component 144 may perform, based at least in part on the indication that the at least one infrastructure sensor operating abnormally, at least one operation. Example operations may include changing vehicle operation, outputting notifications to a driver, sending data to one or more other remote computing devices (e.g., computing devices near computing device 116, such as other vehicle computing devices), or any other suitable operation.

In some examples, image capture component 102C may capture one or more images of an infrastructure article. Interpretation component 118 may select the one or more images from image data 232. Interpretation component 118 may generate a set of infrastructure data for the particular infrastructure article that is proximate to each respective vehicle that includes computing device 116. The infrastructure data may be descriptive of infrastructure articles that are proximate to the respective vehicle. For instance the infrastructure data may indicate an article message, a portion of an article message, a reflectivity of the infrastructure article, a contrast level of the article, any other visual indicia of the infrastructure article, an installation date/time of the infrastructure article, a location or position of the infrastructure article, a type of the infrastructure article, a manufacturer of the infrastructure article, or any other data that is describe of the infrastructure article. Service component may receive such infrastructure data from interpretation component 122 and send the infrastructure data to a remote computing device, such as computing device 534 in FIG. 5 for further processing. In some examples, any of the functionality of computing device 534 or as described in this disclosure may be implemented at computing device 116. In other examples, any of the functionality of computing device 134 may be implemented at computing device 534 as described in this disclosure.

Figure 3:
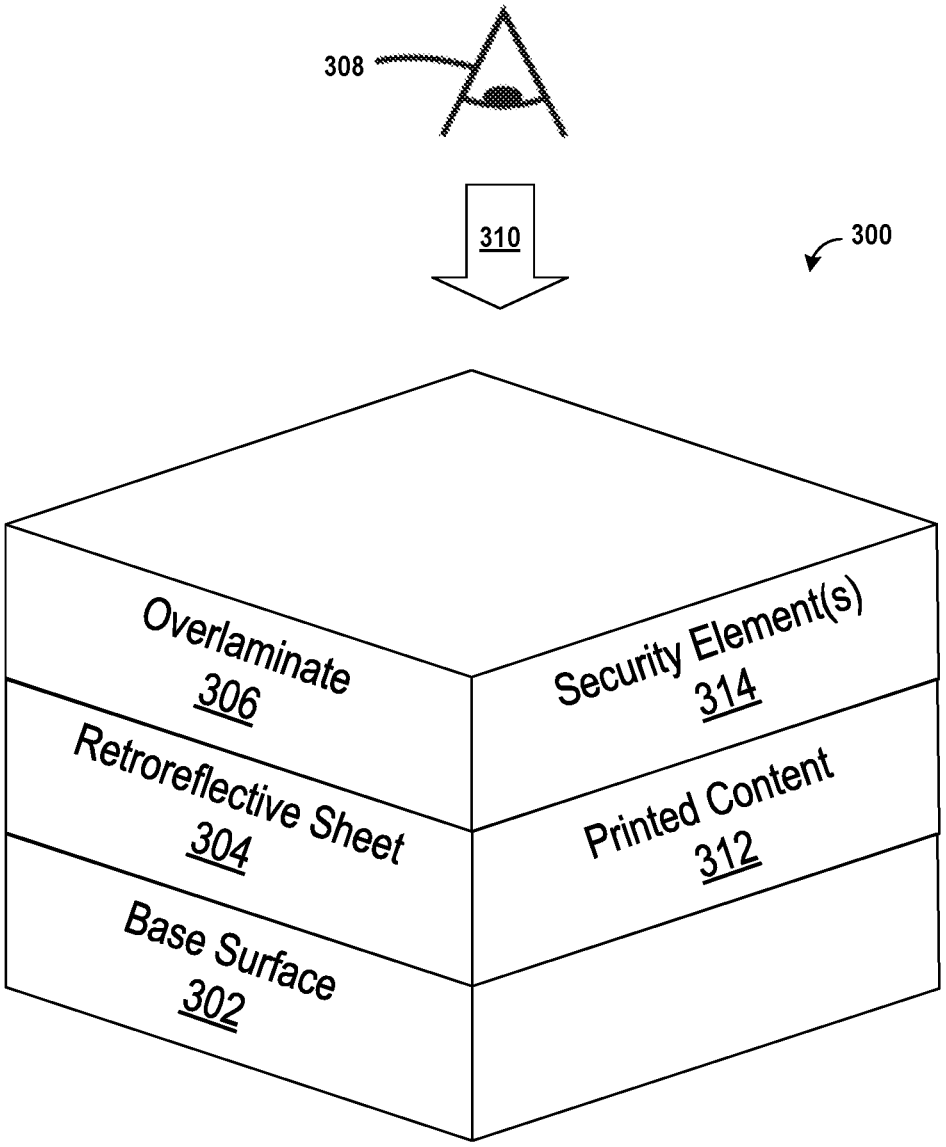
FIG. 3 is a conceptual diagram of a cross-sectional view of a pathway article in accordance with techniques of this disclosure.

FIG. 3 is a conceptual diagram of a cross-sectional view of a pathway article in accordance with techniques of this disclosure. In some examples, such as an enhanced sign, a pathway article may comprise multiple layers. For purposes of illustration in FIG. 3, a pathway article 300 may include a base surface 302. Base surface 302 may be an aluminum plate or any other rigid, semi-rigid, or flexible surface. Retroreflective sheet 304 may be a retroreflective sheet as described in this disclosure. A layer of adhesive (not shown) may be disposed between retroreflective sheet 304 and base surface 302 to adhere retroreflective sheet 304 to base surface 302.

Pathway article may include an overlaminate 306 that is formed or adhered to retroreflective sheet 304. Overlaminate 306 may be constructed of a visibly-transparent, infrared opaque or infrared absorbing material, such as but not limited to multilayer optical film as disclosed in U.S. Pat. No. 8,865,293, which is expressly incorporated by reference herein in its entirety. In some examples, a film used in accordance with techniques of this disclosure may be infrared reflective. In some construction processes, retroreflective sheet 304 may be printed and then overlaminate 306 subsequently applied to reflective sheet 304. A viewer 308, such as a person or image capture device, may view pathway article 300 in the direction indicated by the arrow 310.

As described in this disclosure, in some examples, an article message may be printed or otherwise included on a retroreflective sheet. In such examples, an overlaminate may be applied over the retroreflective sheet, but the overlaminate may not contain an article message. In the example of FIG. 3, visible portions 312 of the article message may be included in retroreflective sheet 304, but non-visible portions 314 of the article message may be included in overlaminate 306. In some examples, a non-visible portion may be created from or within a visibly-transparent, infrared opaque material that forms an overlaminate. European publication No. EP0416742 describes recognition symbols created from a material that is absorptive in the near infrared spectrum but transparent in the visible spectrum. Suitable near infrared absorbers/visible transmitter materials include dyes disclosed in U.S. Pat. No. 4,581,325. U.S. Pat. No. 7,387,393 describes license plates including infrared-blocking materials that create contrast on a license plate. U.S. Pat. No. 8,865,293 describes positioning an infrared-reflecting material adjacent to a retroreflective or reflective substrate, such that the infrared-reflecting material forms a pattern that can be read by an infrared sensor when the substrate is illuminated by an infrared radiation source. EP0416742 and U.S. Pat. Nos. 4,581,325, 7,387,393 and 8,865,293 are herein expressly incorporated by reference in their entireties. In some examples, overlaminate 306 may be etched with one or more visible or non-visible portions.

In some examples, if overlaminate includes non-visible portions 314 and retroreflective sheet 304 includes visible portions 312 of article message, an image capture device may capture two separate images, where each separate image is captured under a different lighting spectrum or lighting condition. For instance, the image capture device may capture a first image under a first lighting spectrum that spans a lower boundary of infrared light to an upper boundary of 900 nm. The first image may indicate which encoding units are active or inactive. The image capture device may capture a second image under a second lighting spectrum that spans a lower boundary of 900 nm to an upper boundary of infrared light. The second image may indicate which portions of the article message are active or inactive (or present or not present). Any suitable boundary values may be used. In some examples, multiple layers of overlaminate, rather than a single layer of overlaminate 306, may be disposed on retroreflective sheet 304. One or more of the multiple layers of overlaminate may have one or more portions of the article message. Techniques described in this disclosure with respect to the article message may be applied to any of the examples described in FIG. 3 with multiple layers of overlaminate.

Although the examples of FIGS. 3-4 describe passivation island constructions, other retroreflective materials may be used. For instance retroreflective materials may have seal films or beads. Pavement marking stripes may, for example, comprise beads as an optical element, but could also use cube corners, such as in raised pavement markings. In some examples, a laser in a construction device, such as construction device as described in this disclosure, may engrave the article message onto sheeting, which enables embedding markers specifically for predetermined meanings. Example techniques are described in U.S. Provisional Patent Application 62/264,763, filed on Dec. 8, 2015, which is hereby incorporated by reference in its entirety. In such examples, the portions of the article message in the pathway article can be added at print time, rather than being encoded during sheeting manufacture. In some examples, an image capture device may capture an image in which the engraved security elements or other portions of the article message are distinguishable from other content of the pathway article. In some examples the article message may be disposed on the sheeting at a fixed location while in other examples, the article message may be disposed on the sheeting using a mobile construction device, as described above.

Figure 4A:
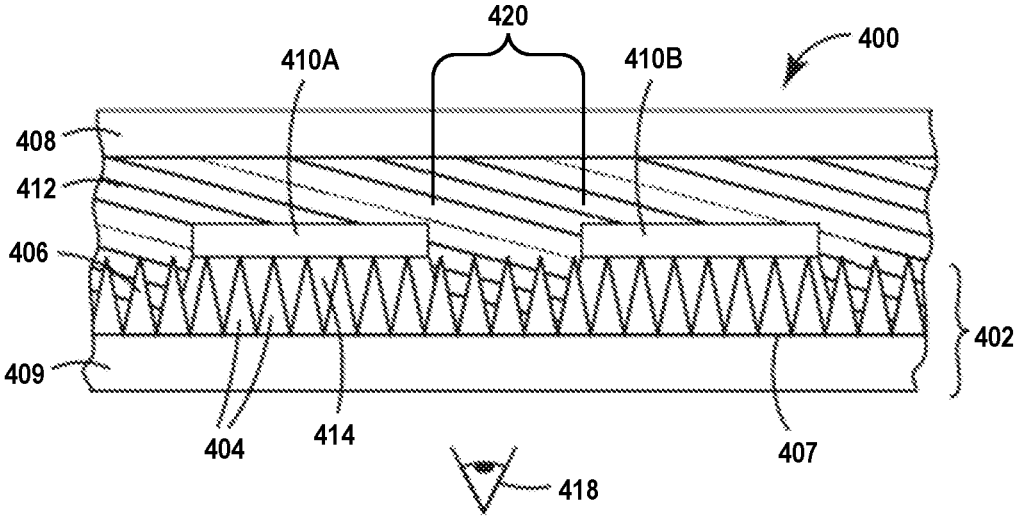
FIGS. 4A and 4B illustrate cross-sectional views of portions of an article message formed on a retroreflective sheet, in accordance with one or more techniques of this disclosure.
Figure 4B:
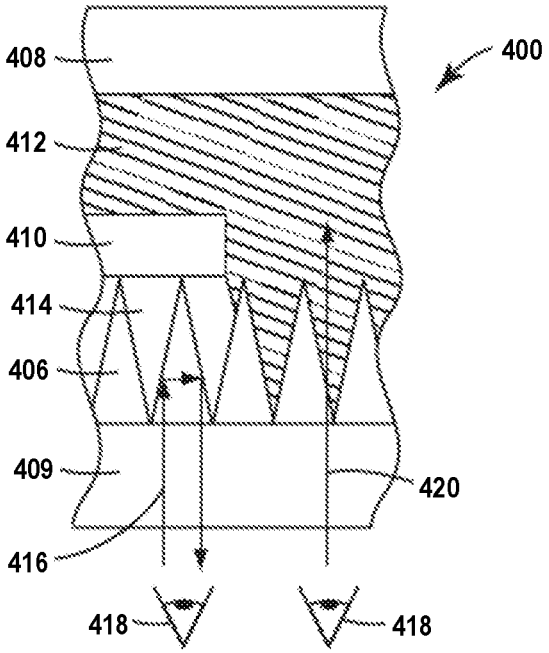

FIGS. 4A and 4B illustrate cross-sectional views of portions of an article message formed on a retroreflective sheet, in accordance with one or more techniques of this disclosure. Retroreflective article 400 includes a retroreflective layer 402 including multiple cube corner elements 404 that collectively form a structured surface 406 opposite a major surface 407. The optical elements can be full cubes, truncated cubes, or preferred geometry (PG) cubes as described in, for example, U.S. Pat. No. 7,422,334, incorporated herein by reference in its entirety. The specific retroreflective layer 402 shown in FIGS. 4A and 4B includes a body layer 409, but those of skill will appreciate that some examples do not include an overlay layer. One or more barrier layers 410 are positioned between retroreflective layer 402 and conforming layer 412, creating a low refractive index area 414. Barrier layers 410 form a physical "barrier" between cube corner elements 404 and conforming layer 412. Barrier layer 410 can directly contact or be spaced apart from or can push slightly into the tips of cube corner elements 404. Barrier layers 410 have a characteristic that varies from a characteristic in one of (1) the areas 412 not including barrier layers (view line of light ray 416) or (2) another barrier layer 412. Exemplary characteristics include, for example, color and infrared absorbency.

In general, any material that prevents the conforming layer material from contacting cube corner elements 404 or flowing or creeping into low refractive index area 414 can be used to form the barrier layer Exemplary materials for use in barrier layer 410 include resins, polymeric materials, dyes, inks (including color-shifting inks), vinyl, inorganic materials, UV-curable polymers, multi-layer optical films (including, for example, color-shifting multi-layer optical films), pigments, particles, and beads. The size and spacing of the one or more barrier layers can be varied. In some examples, the barrier layers may form a pattern on the retroreflective sheet. In some examples, one may wish to reduce the visibility of the pattern on the sheeting. In general, any desired pattern can be generated by combinations of the described techniques, including, for example, indicia such as letters, words, alphanumerics, symbols, graphics, logos, or pictures. The patterns can also be continuous, discontinuous, monotonic, dotted, serpentine, any smoothly varying function, stripes, varying in the machine direction, the transverse direction, or both; the pattern can form an image, logo, or text, and the pattern can include patterned coatings and/or perforations. The pattern can include, for example, an irregular pattern, a regular pattern, a grid, words, graphics, images lines, and intersecting zones that form cells.

The low refractive index area 414 is positioned between (1) one or both of barrier layer 410 and conforming layer 412 and (2) cube corner elements 404. The low refractive index area 414 facilitates total internal reflection such that light that is incident on cube corner elements 404 adjacent to a low refractive index area 414 is retroreflected. As is shown in FIG. 4B, a light ray 416 incident on a cube corner element 404 that is adjacent to low refractive index layer 414 is retroreflected back to viewer 418. For this reason, an area of retroreflective article 400 that includes low refractive index layer 414 can be referred to as an optically active area. In contrast, an area of retroreflective article 400 that does not include low refractive index layer 414 can be referred to as an optically inactive area because it does not substantially retroreflect incident light. As used herein, the term "optically inactive area" refers to an area that is at least 50% less optically active (e.g., retroreflective) than an optically active area. In some examples, the optically inactive area is at least 40% less optically active, or at least 30% less optically active, or at least 20% less optically active, or at least 10% less optically active, or at least at least 5% less optically active than an optically active area.

Low refractive index layer 414 includes a material that has a refractive index that is less than about 1.30, less than about 1.25, less than about 1.2, less than about 1.15, less than about 1.10, or less than about 1.05. In general, any material that prevents the conforming layer material from contacting cube corner elements 404 or flowing or creeping into low refractive index area 414 can be used as the low refractive index material. In some examples, barrier layer 410 has sufficient structural integrity to prevent conforming layer 412 from flowing into a low refractive index area 414. In such examples, low refractive index area may include, for example, a gas (e.g., air, nitrogen, argon, and the like). In other examples, low refractive index area includes a solid or liquid substance that can flow into or be pressed into or onto cube corner elements 404. Exemplary materials include, for example, ultra-low index coatings (those described in PCT Patent Application No. PCT/US2010/031290), and gels.

The portions of conforming layer 412 that are adjacent to or in contact with cube corner elements 404 form non-optically active (e.g., non-retroreflective) areas or cells. In some examples, conforming layer 412 is optically opaque. In some examples conforming layer 412 has a white color.

In some examples, conforming layer 412 is an adhesive. Exemplary adhesives include those described in PCT Patent Application No. PCT/US2010/031290. Where the conforming layer is an adhesive, the conforming layer may assist in holding the entire retroreflective construction together and/or the viscoelastic nature of barrier layers 410 may prevent wetting of cube tips or surfaces either initially during fabrication of the retroreflective article or over time.

In some examples, conforming layer 412 is a pressure sensitive adhesive. The PSTC (pressure sensitive tape council) definition of a pressure sensitive adhesive is an adhesive that is permanently tacky at room temperature which adheres to a variety of surfaces with light pressure (finger pressure) with no phase change (liquid to solid). While most adhesives (e.g., hot melt adhesives) require both heat and pressure to conform, pressure sensitive adhesives typically only require pressure to conform. Exemplary pressure sensitive adhesives include those described in U.S. Pat. No. 6,677,030. Barrier layers 410 may also prevent the pressure sensitive adhesive from wetting out the cube corner sheeting. In other examples, conforming layer 412 is a hot-melt adhesive.

In some examples, a pathway article may use a non-permanent adhesive to attach the article message to the base surface. This may allow the base surface to be re-used for a different article message. Non-permanent adhesive may have advantages in areas such as roadway construction zones where the vehicle pathway may change frequently.

In the example of FIG. 4A, a non-barrier region 420 does not include a barrier layer, such as barrier layer 410. As such, light may reflect with a lower intensity than barrier layers 410A-410B. In some examples, non-barrier region 420 may correspond to an "active" security element. For instance, the entire region or substantially all of image region 142A may be a non-barrier region 420. In some examples, substantially all of image region 142A may be a non-barrier region that covers at least 50% of the area of image region 142A. In some examples, substantially all of image region 142A may be a non-barrier region that covers at least 75% of the area of image region 142A. In some examples, substantially all of image region 142A may be a non-barrier region that covers at least 90% of the area of image region 142A. In some examples, a set of barrier layers (e.g., 410A, 410B) may correspond to an "inactive" security element as described in FIG. 1. In the aforementioned example, an "inactive" security element as described in FIG. 1 may have its entire region or substantially all of image region 142D filled with barrier layers. In some examples, substantially all of image region 142D may be a non-barrier region that covers at least 75% of the area of image region 142D. In some examples, substantially all of image region 142D may be a non-barrier region that covers at least 90% of the area of image region 142D. In the foregoing description of FIG. 4 with respect to security layers, in some examples, non-barrier region 420 may correspond to an "inactive" security element while an "active" security element may have its entire region or substantially all of image region 142D filled with barrier layers.

FIG. 5 is a block diagram illustrating an example computing device, in accordance with one or more aspects of the present disclosure. FIG. 5 illustrates only one example of a computing device, which in FIG. 5 is computing device 134 of FIG. 1. Many other examples of computing device 134 may be used in other instances and may include a subset of the components included in example computing device 134 or may include additional components not shown example computing device 134 in FIG. 5. Computing device 134 may be a remote computing device (e.g., a server computing device) from computing device 116 in FIG. 1.

In some examples, computing device 134 may be a server, tablet computing device, smartphone, wrist- or head-worn computing device, laptop, desktop computing device, or any other computing device that may run a set, subset, or superset of functionality included in application 228. In some examples, computing device 134 may correspond to computing device 134 depicted in FIG. 1. In other examples, computing device 134 may also be part of a system or device that produces signs.

As shown in the example of FIG. 5, computing device 134 may be logically divided into user space 502, kernel space 504, and hardware 506. Hardware 506 may include one or more hardware components that provide an operating environment for components executing in user space 502 and kernel space 504. User space 502 and kernel space 504 may represent different sections or segmentations of memory, where kernel space 504 provides higher privileges to processes and threads than user space 502. For instance, kernel space 504 may include operating system 520, which operates with higher privileges than components executing in user space 502. In some examples, any components, functions, operations, and/or data may be included or executed in kernel space 504 and/or implemented as hardware components in hardware 506.

As shown in FIG. 5, hardware 506 includes one or more processors 508, input components 510, storage devices 512, communication units 514, and output components 516. Processors 508, input components 510, storage devices 512, communication units 514, and output components 516 may each be interconnected by one or more communication channels 518. Communication channels 518 may interconnect each of the components 508, 510, 512, 514, and 516 for inter-component communications (physically, communicatively, and/or operatively). In some examples, communication channels 518 may include a hardware bus, a network connection, one or more inter-process communication data structures, or any other components for communicating data between hardware and/or software.

One or more processors 508 may implement functionality and/or execute instructions within computing device 134. For example, processors 508 on computing device 134 may receive and execute instructions stored by storage devices 512 that provide the functionality of components included in kernel space 504 and user space 502. These instructions executed by processors 508 may cause computing device 134 to store and/or modify information, within storage devices 512 during program execution. Processors 508 may execute instructions of components in kernel space 504 and user space 502 to perform one or more operations in accordance with techniques of this disclosure. That is, components included in user space 502 and kernel space 504 may be operable by processors 508 to perform various functions described herein.

One or more input components 510 of computing device 134 may receive input. Examples of input are tactile, audio, kinetic, and optical input, to name only a few examples. Input components 510 of computing device 134, in one example, include a mouse, keyboard, voice responsive system, video camera, buttons, control pad, microphone or any other type of device for detecting input from a human or machine. In some examples, input component 510 may be a presence-sensitive input component, which may include a presence-sensitive screen, touch-sensitive screen, etc.

One or more communication units 514 of computing device 134 may communicate with external devices by transmitting and/or receiving data. For example, computing device 134 may use communication units 514 to transmit and/or receive radio signals on a radio network such as a cellular radio network. In some examples, communication units 514 may transmit and/or receive satellite signals on a satellite network such as a Global Positioning System (GPS) network. Examples of communication units 514 include a network interface card (e.g. such as an Ethernet card), an optical transceiver, a radio frequency transceiver, a GPS receiver, or any other type of device that can send and/or receive information. Other examples of communication units 514 may include Bluetooth®, GPS, 3G, 4G, and Wi-Fi® radios found in mobile devices as well as Universal Serial Bus (USB) controllers and the like.

One or more output components 516 of computing device 134 may generate output. Examples of output are tactile, audio, and video output. Output components 516 of computing device 134, in some examples, include a presence-sensitive screen, sound card, video graphics adapter card, speaker, cathode ray tube (CRT) monitor, liquid crystal display (LCD), or any other type of device for generating output to a human or machine. Output components may include display components such as cathode ray tube (CRT) monitor, liquid crystal display (LCD), Light-Emitting Diode (LED) or any other type of device for generating tactile, audio, and/or visual output. Output components 516 may be integrated with computing device 134 in some examples.

In other examples, output components 516 may be physically external to and separate from computing device 134, but may be operably coupled to computing device 134 via wired or wireless communication. An output component may be a built-in component of computing device 134 located within and physically connected to the external packaging of computing device 134 (e.g., a screen on a mobile phone). In another example, a presence-sensitive display may be an external component of computing device 134 located outside and physically separated from the packaging of computing device 134 (e.g., a monitor, a projector, etc. that shares a wired and/or wireless data path with a tablet computer).

One or more storage devices 512 within computing device 134 may store information for processing during operation of computing device 134. In some examples, storage device 512 is a temporary memory, meaning that a primary purpose of storage device 512 is not long-term storage. Storage devices 512 on computing device 134 may configured for short-term storage of information as volatile memory and therefore not retain stored contents if deactivated. Examples of volatile memories include random access memories (RAM), dynamic random access memories (DRAM), static random access memories (SRAM), and other forms of volatile memories known in the art.

Storage devices 512, in some examples, also include one or more computer-readable storage media. Storage devices 512 may be configured to store larger amounts of information than volatile memory. Storage devices 512 may further be configured for long-term storage of information as non-volatile memory space and retain information after activate/off cycles. Examples of non-volatile memories include magnetic hard discs, optical discs, floppy discs, flash memories, or forms of electrically programmable memories (EPROM) or electrically erasable and programmable (EEPROM) memories. Storage devices 512 may store program instructions and/or data associated with components included in user space 502 and/or kernel space 504.

As shown in FIG. 5, application 528 executes in userspace 502 of computing device 134. Application 528 may be logically divided into presentation layer 522, application layer 524, and data layer 526. Application 528 may include, but is not limited to the various components and data illustrated in presentation layer 522, application layer 524, and data layer 526.

Data layer 526 may include one or more datastores. A datastore may store data in structure or unstructured form. Example datastores may be any one or more of a relational database management system, online analytical processing database, table, or any other suitable structure for storing data.

In accordance with techniques of this disclosure, application 528 may include interface component 530. In some examples, interface component 530 may generate output to a user or machine such as through a display, such as a display screen, indicator or other lights, audio devices to generate notifications or other audible functions, haptic feedback or any suitable output. In some examples, interface component 530 may receive any indications of input from user or machine, such as via knobs, switches, keyboards, touch screens, interfaces, or any other suitable input components.

In the example of FIG. 5, a set of vehicles may each communicate with application 528. Each respective vehicle in the set of vehicles may include at least one infrastructure sensor that generates infrastructure data 532 that is descriptive of infrastructure articles (e.g., sign 108) that are proximate to the respective vehicle. Each vehicle may include one or more communication devices to transmit the infrastructure data to application 528.

Application 528 may receive and store infrastructure data 532 in data layer 526. In some examples, application 528 may receive, from the set of vehicles and via interface component, different sets of infrastructure data for a particular infrastructure article that is proximate to each respective vehicle of the set of vehicles. Data management component 534 may store, retrieve, create, and delete infrastructure data 532. In some examples, data management component 534 may perform pre-processing operations on data received from remote computing devices before it is stored as infrastructure In some examples, "proximate" may mean a distance between the vehicle and infrastructure article that is within a threshold distance. In some examples, the threshold distance may be a maximum distance that camera from a vehicle receives an image with a defined resolution. In some examples, the threshold distance is within a range of between zero and one mile. In some examples, the threshold distance may be within a range of 0-5 meters, 0-15 meters, 0-25 meters, 0-50 meters, or any other suitable range.

In some examples, infrastructure component 536 may determine, based at least in part on the different sets of infrastructure data for the particular infrastructure article from each respective vehicle of the set of vehicles, a quality metric for the infrastructure article. For instance, infrastructure component 536 may determine an average, median, mode, or any other aggregate or statistical value that collectively represents multiple samples of infrastructure data for the particular infrastructure article from multiple vehicles. In some examples, the quality metric may indicate a degree of quality of the article of infrastructure. In some examples, the quality metric may be a discrete value or a non-discrete value.

In some examples, infrastructure component 536 may include a model that generates a classification corresponding to a quality metric, where the classification is based at least in part on applying infrastructure data to the model. In some examples, infrastructure component 536 may perform this classification using machine learning techniques. Example machine learning techniques that may be employed to generate models can include various learning styles, such as supervised learning, unsupervised learning, and semi-supervised learning. Example types of algorithms include Bayesian algorithms, Clustering algorithms, decision-tree algorithms, regularization algorithms, regression algorithms, instance-based algorithms, artificial neural network algorithms, deep learning algorithms, dimensionality reduction algorithms and the like. Various examples of specific algorithms include Bayesian Linear Regression, Boosted Decision Tree Regression, and Neural Network Regression, Back Propagation Neural Networks, the Apriori algorithm, K-Means Clustering, k-Nearest Neighbour (kNN), Learning Vector Quantization (LUQ), Self-Organizing Map (SOM), Locally Weighted Learning (LWL), Ridge Regression, Least Absolute Shrinkage and Selection Operator (LASSO), Elastic Net, and Least-Angle Regression (LARS), Principal Component Analysis (PCA) and Principal Component Regression (PCR).

In some examples, a model is trained using supervised and/or reinforcement learning techniques. In some examples, infrastructure component 536 initially trains the model based on a training set of (1) sets of infrastructure data that correspond to (2) quality metrics. The training set may include a set of feature vectors, where each feature in the feature vector represents a value in a particular set of infrastructure data and a corresponding quality metric. Infrastructure component 536 may select a training set comprising a set of training instances, each training instance comprising an association between a set of infrastructure data and a corresponding quality metric. Infrastructure component 536 may, for each training instance in the training set, modify, based on a particular infrastructure data and corresponding particular quality metric of the training instance, the model to change a likelihood predicted by the model for the particular quality metric in response to subsequent infrastructure data applied to the model. In some examples, the training instances may be based on real-time or periodic data generated by vehicles.

In some examples, service component 538 may receive the quality metric from infrastructure component 536. Infrastructure component 536 may perform at least one operation based at least in part on the quality metric for the infrastructure article. Service component 538 may perform any number of operations and/or services as described in this disclosure. Example operations may include, but are not limited to, sending notifications or messages to one or more computing devices, logging or storing quality metrics, performing analytics on the quality metrics (e.g., identifying anomalies, event signatures, or the like), or performing any other suitable operations.

In some examples, application 528 may operate as a sign management system that inventories various properties of each respective infrastructure article and identifies particular infrastructure articles that require further inspection and/or replacement. For example, data management component 534 may store one or more properties of infrastructure articles in infrastructure data 532, such as but not limited to: infrastructure article type, infrastructure article location, infrastructure article unique identifier, last detected date of infrastructure article, infrastructure qualities (e.g., brightness, contrast, is damaged, is occluded, orientation, retroreflectance, color, or any other property indicating quality), infrastructure article installation date, or any other properties. In some examples, infrastructure component 536 and/or service component 538 may determine whether, based at least in part on one or more of the properties of infrastructure, the article of infrastructure should or must be inspected and/or replaced. Based at least in part on this determination, service component 538 may generate a notification to one or more computing devices (e.g., a custodian of a roadway that includes the infrastructure article to inspect or replace, a vehicle, a manufacturer of the infrastructure article, or any other computing device); generate, store, or log an event that indicates a threshold is or is not satisfied that is based at least in part on the infrastructure properties; or perform any other suitable operations.

In the example of FIG. 5, infrastructure data 532 is at least one of raw data generated by the infrastructure sensor or an identifier of the infrastructure article. An identifier of an infrastructure article may uniquely identify the infrastructure article. In some examples, an identifier of an infrastructure article may identify a type of the infrastructure article. In some examples, infrastructure data 532 comprises an identifier of the infrastructure article and infrastructure data 532 indicates a confidence level that the identifier correctly identifies the type of the infrastructure article. In some examples, the quality metric for a particular article of infrastructure is based on sets of infrastructure data collected over a time series, which may be used to detect trends. In some examples, the quality metric indicates a degree of contrast or a degree of decodability of a visual identifier. In some examples, infrastructure data 532 may include a GPS coordinate set that corresponds to a location of a sign.

In some examples, service component 538 and/or infrastructure component 536 may generate a confidence score associated with the quality metric that indicates a degree of confidence that the quality metric is valid. In some examples, service component 538 and/or infrastructure component 536 may perform one or more operations in response to determining that the quality metric satisfies or does not satisfy a threshold. In some examples, satisfying or not satisfying a threshold may include a value being greater than, equal to, or less than the threshold. In some examples, service component 538 may, in response to a determination that the quality metric does not satisfy a threshold, may notify a custodian of the particular infrastructure article. In some examples, if an article of infrastructure is expected at a particular location by infrastructure component 536, but no data is received that indicate the presence of the article (or data is received indicating the absence of the article) from one or more vehicles, then infrastructure component 536 may perform an operation in response to that determination. For instance, the operation may include, but is not limited to generating an alert to a custodian of the roadway or infrastructure article, generating an alert to one or more other entities, logging the event, or performing any other number of suitable operations. In some examples, service component 538 may, in response to a determination that the quality metric does not satisfy a threshold, notify a vehicle manufacturer. In some examples, service component 538 may determine that the quality metric is more than one standard deviation below the mean for similar infrastructure articles. In some examples, service component 538 may determine an anomaly in a sensor of a vehicle or an environment of the vehicle. In some examples, service component 538 may send an indication of the quality metric to at least one other vehicle for use to modify an operation of the at least one other vehicle in response to detection of the infrastructure article.

In some examples, infrastructure component 536 may determine the quality metric based at least in part on infrastructure data from a plurality of infrastructure sensors that are applied to a model that predicts the quality metric. In some examples, the infrastructure article is retroreflective. In some examples, the infrastructure data descriptive of infrastructure articles comprises a classification that is based at least in part on raw data generated by the infrastructure sensor, and the infrastructure data is generated at the respective vehicle. Raw data may be output generated directly and initially from an infrastructure sensor without additional processing or transforming of the output. For example, the infrastructure data may be the result of pre-processing by the respective vehicle of raw sensor data, wherein the classification comprises less data than the raw data on which the classification is generated. In some examples, infrastructure component 536 may select different sets of infrastructure data from a set of infrastructure data generated by a larger number of vehicles than the set of vehicles. That is, infrastructure component 536 may discard or ignore certain sets of infrastructure data from infrastructure data 532 based on one or more criteria (e.g., anomalous criteria, temporal criteria, locational criteria, or any other suitable criteria). In some examples, at least one infrastructure sensor of each respective vehicle generates raw data descriptive of infrastructure articles that are proximate to the respective vehicle. Each respective vehicle may include at least one computer processor that pre-processes the raw data to generate the infrastructure data, wherein the infrastructure data comprises less data than the raw data. In some examples, the at least one computer processor, to generate the infrastructure data, may generate a quality metric for at least one infrastructure article, and the at least one computer processor may include the quality metric in the infrastructure data. In some examples, computing device 534 is included within a vehicle. In some examples, computing device 534 is physically separate from a vehicle.

In some examples, techniques of this disclosure may include collecting crowdsourced infrastructure data; aggregating, analyzing and interpreting that data; preparing it to report or inform infrastructure owner operators of current and future status. Techniques may include preparing to report or inform vehicles on potential adjustments to sensors or reliance on specific sensor modalities. In some examples, the techniques may augment the capabilities of HD maps by providing reliability/quality data as an overlay of additional data for infrastructure in the maps.

In some examples, techniques of this disclosure may provide certain benefits. For automakers and departments of transportation, there may be no available method to provide data from one to the other on specific details of a roadway. Automakers today may collect sensor data to enable their automated driver assistance systems (ADASs), which may be a large volume of data. Likewise, DOT's may spend money and time to ensure their roadways are safe or at least meeting the minimum standards set by Federal and State governing bodies. Some companies may collect information from vehicles to aggregate and resell across many vehicle vendors to create self-healing high-definition maps. Techniques of this disclosure may enable vehicle sourced sensor data to be aggregated and processed through quality scoring techniques in order to generate roadway quality metrics both for use in vehicle and by the DOT or roadway infrastructure owner operator for maintenance and construction planning. The techniques may also link to a road classification system—where a roadway is given an automation readiness score based on the quality of many of the infrastructure components like signs, pavement markings and road surface.

In some examples, application 528 may identify correlations with weather that could be useful to recommend infrastructure upgrades in combination with the number of vehicles depending on a sign (e.g., snow rests on the sign to application 528 recommends a different material that is more appropriate for that location with large volumes of vehicles passing by. In some examples, application 528 may recommend different infrastructure placement.

In some examples, if vehicles are reliably reporting metrics out to an external aggregator such as application 528, then application 528 could also identify statistically significant changes in frequency of quality reports to generate an indicating that a sign might be missing/damaged (i.e.: 200 reads on sign 1, 50 reads on sign 2, 200 reads on sign 3 in series). In some examples, application 528 could use quality evaluation frequency to provide metrics to a department of transportation about road usage and resource priority.

Figure 6:
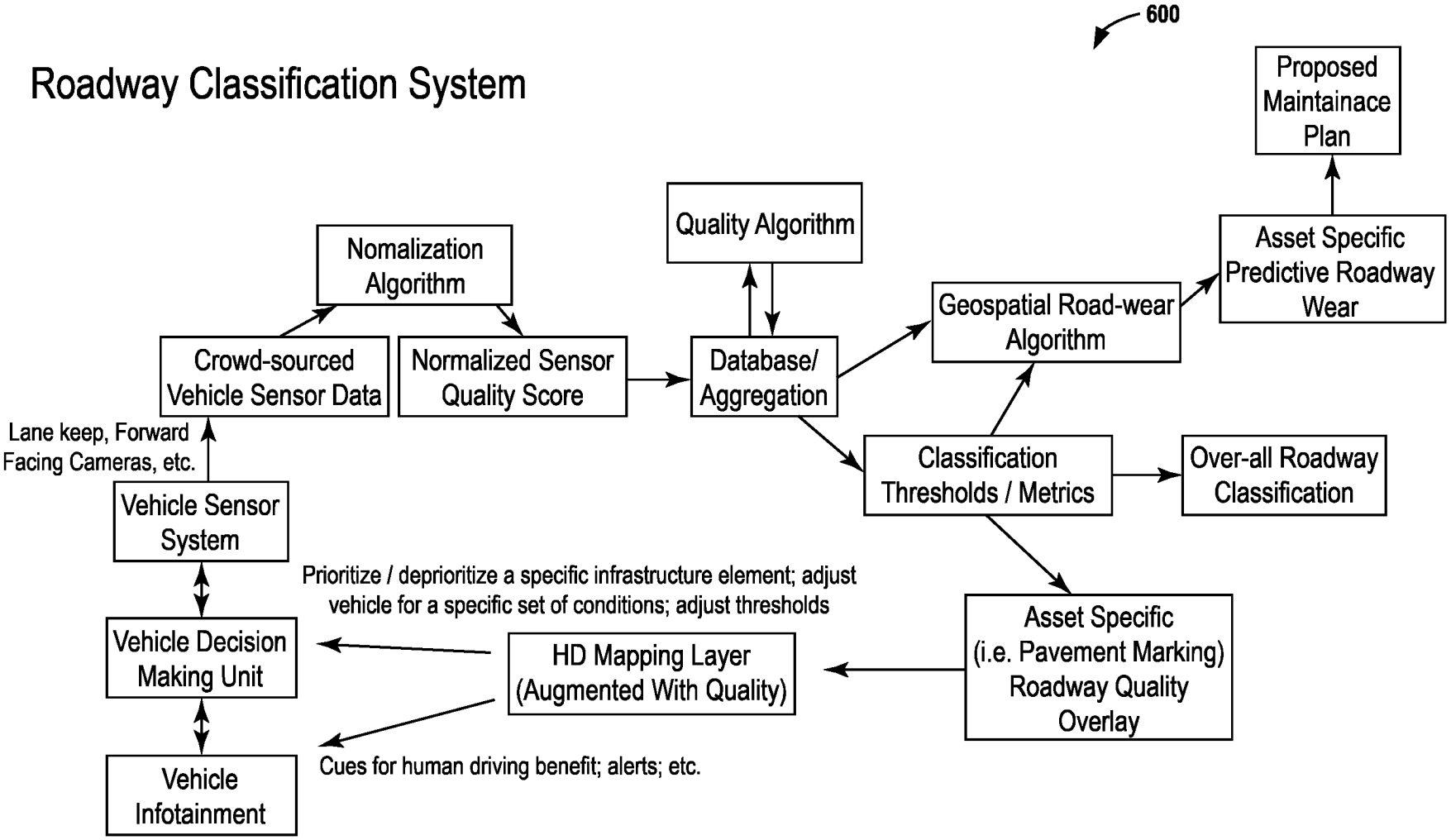
FIG. 6 illustrates a roadway classification system, in accordance with techniques of this disclosure.

FIG. 6 illustrates a roadway classification system 600 in accordance with techniques of this disclosure. In some examples, one or more functions or operations of FIG. 6 may be implemented and/or performed by computing devices 116 and/or 134 of FIGS. 1, 2, and 5. FIG. 6 is an example of a system 600 which may be a roadway classification system based on crowdsourced (or vehicle sourced) sensor data, and specific operations designed to analyze sparse sets of vehicle soured data to create a universal quality scoring system where roadways may be assigned a score based on this system. System 600 may provide provisions for outputting this resulting information into various forms and levels of aggregation for infrastructure owner/operators and vehicle navigation/ADAS systems as well.

ADAS equipped vehicles may navigate roads utilizing sensors to make driving decisions, and at the same time create data correlating to classifications of infrastructure materials, and often a confidence score rating the likelihood that a classification of the infrastructure (e.g., based one or more sets of captured data) matches the ground truth for the article (e.g., what is actually the state of the infrastructure article). Techniques of this disclosure may utilize this classification and confidence data to ascertain the quality of the infrastructure materials being sensed. In some instances, infrastructure quality is held to human vision standards, and there may be no mandated standard for machine vision properties. In some instances, there will be minimum standards required to ensure some level of operation for machine visions systems (e.g., SAE J3016—levels of automation standard).

Evaluation of performance and determining if a road is meeting standards may be performed by either evaluating the technical performance of each individual piece of infrastructure, or by a subjective trained human perspective. This often requires specific driving trips dedicated to assessing quality of, for example, signage or pavement markings, and can be quite costly to evaluate assets across an entire jurisdiction. In accordance with techniques of this disclosure, quality data (machine vision quality and/or some level of visual quality) may be gathered by the same machine vision systems using the data i.e. from the cars on the road. Rather than selecting one exemplary system to be an absolute standard system, utilizing aggregated data from actual cars on the road may provide more accurate quality scoring.

In some instances, there are challenges associated with this crowd- or vehicle-sourced sensor data, because interpretation may be needed to normalize confidences, scoring, and/or classification outputs. There may also be many contributions to the measured "quality" on any given day, weather, lighting, obscuration, etc., and these factors may need to be taken into consideration. In some instances, situational anomalies may not necessarily describe a pavement marking or sign which is not meeting minimum retroreflectivity or other performance standards, but it may indicate a failure to meet adequate readability given some subset of context. This may be a different way of measuring quality, and the results may likely be much more granular than a binary "good" or "bad" classification. In some instances, anomalies or other signatures or events may suggest that a particular section of road has insufficient pavement markings when it is raining, or that, for instance, from 5 am-6 am every day a particular sign is not classifiable/decodable due to solar specular reflection. Both these singularities and the larger scale sensor data measurements may be of value to the AOEM (auto original equipment manufacturers) and the TOO (infrastructure owner operators). Identifying these singularities or causes for performance deviations, as well as characterizing patterns of confidence data to ascertain a roadway classification are both techniques which may be performed by one or more computing devices in this disclosure.

Techniques of this disclosure may enable the ability to provide prescriptive recommendations for implementation of infrastructure materials based on the correlations between assets, traffic congestion and incident data as described throughout and in the following sections:

Benefits to the AOEM/Vehicle

To enable higher levels of automation in vehicles, multiple levels of redundancy may be used for driving decisions that the vehicle system executes. In some instances, the vehicle may be considering a multitude of vehicle sensor streams, attempting to fuse them together and ascertain one unanimous decision on what to do next to execute a safe driving maneuver. There may be disagreement in the sensor data-streams on how to proceed (e.g., decide which sensor stream has more or total influence on decisions of the system). In such examples, the vehicle or sensor fusion system (e.g., which may be implemented by computing device 116) may use weighting metrics to give higher value to more trusted data sources. Trust or confidence may be established by a confidence score communicated from a particular sensor system. This confidence may be based on an internal assessment of the likelihood that the data is valid. In conventional systems, details as to how that confidence is calculated, and the accuracy of that calculation or the certainty of the result may not be available.

With the information provided by an infrastructure quality mapping layer, it may be possible to intelligently modify the vehicle fusion weightings to more gracefully adapt the system to make smart decisions with varying qualities of data. This may allow for a dynamic level of trust assigned to each piece of data that comes in weighted by more than the specific cars sensor confidence. For instance, the vehicle fusion system (e.g., included in computing device 116) may use or select the aggregated quality score for a particular piece of infrastructure (like pavement marking) and temper the result for that sensor based on historical quality of measurements. This technique may de-risk a potential incorrect read for any vehicle sensor interfacing with the infrastructure. This can be accomplished by the vehicle fusion system interpreting quality scores from previous vehicles asserting the state of a given line or sign etc.

As an example, if a pavement marking in an area historically has a very high quality score, then computing device 134, for instance, may inform the car to place a higher weight on the data coming from the lane keeping system, because it can trust the data with more certainty due to past performance in that area. Likewise, a particular stop sign which is aging and has poor aggregated quality score can be de-prioritized, based on information from computing device 134, when the vehicle is determining where to stop in an upcoming intersection, as it is more likely to improperly decode the sign message than if the sign was higher quality.

In some instances, techniques of this disclosure may make it possible to aggregate quality scores across many vehicle types, sensor systems, brands, etc. This provides a method for system operation comparison based on real world data; which can have value for safety ratings, performance ratings, competitive advantage etc. It may also transform lab style closed loop testing data into a real-world performance measurement, something that has much more applicability and meaning to both the AOM, Sensor manufacturers (Tiers) and the driving public.

Benefits to DOT/Infrastructure Owner/Operator

In some instances, safety is a high (or highest) priority for the agencies that manage and operate the roadways, safety for the drivers, and the maintenance crews. Another high priority is efficiently spending taxpayer dollars to maximize the safety of the roadway. Techniques of this disclosure may enable optimization or improvement of one or more priorities by using the infrastructure quality scores to prioritize the roadways with the highest opportunities in both infrastructure improvement and safety improvement based on actual roadway data.

Initially even with a small percentage of vehicles reporting data, roadway quality information may be utilized computing device 134 to provide recommendations on which roadways require maintenance immediately. Computing device 134 may also identify or pinpoint specific areas of degradation, which in the case of pavement markings may give opportunity to selectively repair lane markings or edge lines rather than restriping an entire roadway if it is not needed.

Quality metrics for the different pieces of infrastructure/roadway furniture can roll up across a segment of road and offer a vehicle-sourced sensor data set, which may define the level of automation possible for a given roadway. As markings degrade, or signage is bent or becomes more difficult to read, the vehicle data quality metrics (e.g., averages or other statistics or classifications) generated by computing device 134 may drop for these pieces of infrastructure, and eventually the level of automation possible on a given roadway may need to be decreased as the infrastructure becomes less reliable, and the necessary source of data redundancy may no longer be trusted. Such techniques may enable a fully automated mechanism for evaluating roadway quality as well as classifying a roadway for a level of automation readiness.

At any given time, the road may tell the vehicle what level of automation it currently supports based on its infrastructure compatibility and quality so that safe driving is possible at every level—with varying level of human and computer decision making.

Techniques of this disclosure may utilize years of expertise in infrastructure wear and aging as well as data from similar geographical locations around the nation/world to predict how a piece of infrastructure will age, and provide data-based recommendations on road maintenance/repairs offered in a timeline which is consistent with agency construction planning timetables (e.g., offer roads that will need repaving or restriping 12-18 months in the future, rather than today or yesterday). Such techniques may enable TOO's to be proactive in maintenance, while having a certain level of confidence that they are not replacing infrastructure that still has years of time/quality left, but also may not require IOO's to acquire funds for a last-minute project because they did not have sufficient warning a roads quality was declining.

Signage Quality Scoring

Techniques of this disclosure may determine the "quality" of a 2D barcoded or optical-coded sign by measuring several factors contributing to a successful decode of the code. In some instances, the GPS coordinates of the car when the sign is first detected, and the GPS coordinates of the sign when it can first be decoded allow distance vector determination and give read ranges, which can contribute to the makeup of a quality score for a particular sign. The contrast ratio of the dark and light (on and off) modules of the 2D code can be used as well as some indication of the cameras perceived quality of the sign.

Using brightness as a measure of retroreflectivity, and thus performance of a sign, may be used as infrastructure data in the validity of that measurement or determination. Utilizing a camera's perception of how light "bright" modules (e.g., an region or area of an optical code) are and how dark the "quiet" modules are may indicate, for that exact image of the code, how easily the machine vision system can differentiate the 1's and 0's of the optical code; and this may relate directly or indirectly to quality. In addition, a number of blocks (e.g., a set of modules) correctly decoded may indicate a measure of the quality of the sign; whether it is partially obscured, or blocked in some way. In some instances, a temporary occlusion could just be a truck in the way, but it may affect the quality scoring of that particular read since many blocks when compared to what they should have decoded would be incorrect. In the event of such a scenario that is not indicative of actual sign quality problems, the result will be an anomaly and when compared to the thousands of 'normal' or unobstructed reads of that sign, and would be minimized by the averaging. Taking these vehicle sensor and decode quality data points enables a new way of evaluating the effectiveness of a sign, and allows for trend analysis as time goes on, continuously evaluating for changes in aggregated quality scoring across all signs in an ecosystem. In some examples, inventorying signs may include capturing different types of information about each sign, such as but not limited to: presence/existence of sign, condition, orientation, obstruction, brightness (night/retro) and/or daytime appearance to name only a few examples. Any such types of information may be access using multi-dimensional optical codes. Color may also be a type of information captured by such systems where fading may affect the contrast radio of a sign or other infrastructure article even through brightness may still be at an acceptable level.

There are other examples of similar but different inputs which can be considered to create a quality metric for signage.

Pavement Marking Quality Techniques

While signs may be unique and singular entities, pavement markings may be continuous (or dotted, but still goes on for miles without specific unique features) which may provide additional opportunities to capture infrastructure quality data. In some instances, every point could be measured and reported for quality on a continuous basis, each vehicle creating a heat-map of pavement marking quality. This, however, may be data intensive, and may consume substantial bandwidth for pushing data from the vehicle. In some instances, identifying sections of transition in quality and tagging a given segment with a single quality score allows just a subset of pieces of information to be transmitted for any given consistent quality segment. For example, a lane guidance system may have identified the left line and classified it as solid yellow with a confidence of 3. When the lane guidance system (e.g., implemented in computing device 116) first makes this determination, it may log the GPS coordinate of the line, and hold until it perceives either a classification change or a confidence change. Once a change occurs the lane guidance system can send to computing device 134 the segment data from the start of the solid yellow 3 confidence zone, to the end of that zone; marking a piece of the line with a given confidence. The quality score for a local segment then can be extracted from that data by computing device 134; or an overall roadway score may be computed based on a combination of all of the lines in a given area, or a particular section can be analyzed and awarded a quality score based on the lines and their scores in the defined area.

Techniques of this disclosure may enable the creation or generation of quality scoring metrics which can be applied to sensor data and aggregated to enable vehicles to more gracefully navigate through varying qualities of infrastructure as well as enable DOT's to focus their resources on maintaining top quality (safe) roadways for their drivers both today and in the future.

Included herein an exemplary list of potential sensed characteristics about infrastructure (e.g., infrastructure data descriptive of infrastructure articles), and many other examples are possible:

Pavement markings—classification, quality and location, embedded/encoded data obtained from lane departure/lane guidance systems.

Signage—from forward facing or angled camera or LiDAR: assuming a vehicle performs detection and classification, computing device 134 may receive that information, GPS location, quality info, embedded data in optical codes.

Potholes or road degradation—vibration sensors or accelerometers in wheels/suspension system. Computing device 134 may receive GPS and accelerometer data.

Slippage/Skidding event—may be logged in other types of systems, but could be indicative of a need for change in the management of ice/snow/oil/etc. Sensors capturing data may include anti-lock brake activation, wheel slippage etc.

Computing device 134 may include or be communicatively coupled to construction component 517, in the example where computing device 134 is a part of a system or device that produces signs, such as described in relation to computing device 134 in FIG. 1. In other examples, construction component 517 may be included in a remote computing device that is separate from computing device 134, and the remote computing device may or may not be communicatively coupled to computing device 134. Construction component 517 may send construction data to construction device, such as construction device 138 that causes construction device 138 to print an article message in accordance with a printer specification and data indicating one or more characteristics of a vehicle pathway.

As described above in relation to FIG. 1, construction component 517, may receive data that indicates at least one characteristic of a vehicle pathway. Construction component 517, in conjunction with other components of computing device 134, may determine an article message that indicates at least one characteristic of the vehicle roadway. As described above in relation to FIG. 1, the article message may include a graphical symbol, a fiducial marker and one or more additional elements that may contain the one or more characteristics of the vehicle roadway. The article message may include both machine-readable and human readable elements. Construction component 517 may provide construction data to construction device 138 to form the article message on an optically active device, which will be described in more detail below. In some examples, computing device 134 may communicate with construction device 138 to initially manufacture or otherwise create enhanced sign 108 with an article message. Construction device 138 may be used in conjunction with computing device 134, which may control the operation of construction device 138, as in the example of computing device 134 of FIG. 1.

In some examples, construction device 138 may be any device that prints, disposes, or otherwise forms an article message 126 on enhanced sign 108. Examples of construction device 138 include but are not limited to a needle die, gravure printer, screen printer, thermal mass transfer printer, laser printer/engraver, laminator, flexographic printer, an ink jet printer, an infrared-ink printer. In some examples, enhanced sign 108 may be the retroreflective sheeting constructed by construction device 138, and a separate construction process or device, which is operated in some cases by a different operators or entities than construction device 138, may apply the article message to the sheeting and/or the sheeting to the base layer (e.g., aluminum plate).

Construction device 138 may be communicatively coupled to computing device 134 by a communication link 130C. Computing device 134 may control the operation of construction device 138 or may generate and send construction data to construction device 138. Computing device 134 may include one or more printing specifications. A printing specification may comprise data that defines properties (e.g., location, shape, size, pattern, composition or other spatial characteristics) of article message 126 on enhanced sign 108. In some examples, the printing specification may be generated by a human operator or by a machine. In any case, construction component 517 may send data to construction device 138 that causes construction device 138 to print an article message in accordance with the printer specification and the data that indicates at least one characteristic of the vehicle pathway.

The components of article message 126 on enhanced sign 108 depicted in FIG. 1 may be printed using a flexographic printing process. For instance, enhanced sign 108 may include a base layer (e.g., an aluminum sheet), an adhesive layer disposed on the base layer, a structured surface disposed on the adhesive layer, and an overlay layer disposed on the structured surface such as described in U.S. Publication US2013/0034682, US2013/0114142, US2014/0368902, US2015/0043074, which are hereby expressly incorporated by reference in their entireties. The structured surface may be formed from optical elements, such as full cubes (e.g., hexagonal cubes or preferred geometry (PG) cubes), or truncated cubes, or beads as described in, for example, U.S. Pat. No. 7,422,334, which is hereby expressly incorporated by reference in its entirety.

To create non-visible components at different regions of the pathway article, a barrier material may be disposed at such different regions of the adhesive layer. The barrier material forms a physical "barrier" between the structured surface and the adhesive. By forming a barrier that prevents the adhesive from contacting a portion of the structured surface, a low refractive index area is created that provides for retroflection of light off the pathway article back to a viewer. The low refractive index area enables total internal reflection of light such that the light that is incident on a structured surface adjacent to a low refractive index area is retroreflected. In this embodiment, the non-visible components are formed from portions of the barrier material.

In other embodiments, total internal reflection is enabled by the use of seal films which are attached to the structured surface of the pathway article by means of, for example, embossing. Exemplary seal films are disclosed in U.S. Patent Publication No. 2013/0114143, and U.S. Pat. No. 7,611,251, all of which are hereby expressly incorporated herein by reference in their entirety.

In yet other embodiments, a reflective layer is disposed adjacent to the structured surface of the pathway article, e g enhanced sign 108, in addition to or in lieu of the seal film. Suitable reflective layers include, for example, a metallic coating that can be applied by known techniques such as vapor depositing or chemically depositing a metal such as aluminum, silver, or nickel. A primer layer may be applied to the backside of the cube-corner elements to promote the adherence of the metallic coating.

In some examples construction device 138 may be at a location remote from the location of the signs. In other examples, construction device 138 may be mobile, such as installed in a truck, van or similar vehicle, along with an associated computing device, such as computing device 134. A mobile construction device may have advantages when local vehicle pathway conditions indicate the need for a temporary or different sign. For example, in the event of a road washout, where there is only one lane remaining, in a construction area where the vehicle pathway changes frequently, or in a warehouse or factory where equipment or storage locations may change. A mobile construction device may receive construction data, as described, and create an enhanced sign at the location where the sign may be needed. In some examples, the vehicle carrying the construction device may include sensors that allow the vehicle to traverse the changed pathway and determine pathway characteristics. In some examples, the substrate containing the article message may be removed from a sign base layer and replaced with an updated substrate containing a new article message. This may have an advantage in cost savings.

Computing device 134 may receive data that indicates characteristics or attributes of the vehicle pathway from a variety of sources. In some examples, computing device 134 may receive vehicle pathway characteristics from a terrain mapping database, a light detection and ranging (LIDAR) equipped aircraft, drone or similar vehicle. As described in relation to FIG. 1, a sensor equipped vehicle may traverse, measure and determine the characteristics of the vehicle pathway. In other examples, an operator may walk the vehicle pathway with a handheld device. Sensors, such as accelerometers may determine pathway characteristics or attributes and generate data for computing device 134. As described in relation to FIG. 1, computing device 134 may receive a printer specification that defines one or more properties of the pathway article. The printer specification may also include or otherwise specify one or more validation functions and/or validation configurations, as further described in this disclosure. To provide for counterfeit detection, construction component 517 may print security elements and article message in accordance with validation functions and/or validation configurations. A validation function may be any function that takes as input, validation information (e.g., an encoded or literal value(s) of one or more of the article message and/or security elements of a pathway article), and produces a value as output that can be used to verify whether the combination of the article message indicates a pathway article is authentic or counterfeit. Examples of validation functions may include one-way functions, mapping functions, or any other suitable functions. A validation configuration may be any mapping of data or set of rules that represents a valid association between validation information of the one or more security elements and the article message, and which can be used to verify whether the combination of the article message and validation information indicate a pathway article is authentic or counterfeit. As further described in this disclosure, a computing device may determine whether the validation information satisfies one or more rules of a validation configuration that was used to generate the construct the pathway article with the article message and the at least one security element, wherein the one or more rules of the validation configuration define a valid association between the article message and the validation information of the one or more security elements.

The following examples provide other techniques for creating portions of the article message in a pathway article, in which some portions, when captured by an image capture device, may be distinguishable from other content of the pathway article. For instance, a portion of an article message, such as a security element may be created using at least two sets of indicia, wherein the first set is visible in the visible spectrum and substantially invisible or non-interfering when exposed to infrared radiation; and the second set of indicia is invisible in the visible spectrum and visible (or detectable) when exposed to infrared. Patent Publication WO/2015/148426 (Pavelka et al) describes a license plate comprising two sets of information that are visible under different wavelengths. The disclosure of WO/2015/148426 is expressly incorporated herein by reference in its entirety. In yet another example, a security element may be created by changing the optical properties of at least a portion of the underlying substrate. U.S. Pat. No. 7,068,434 (Florczak et al), which is expressly incorporated by reference in its entirety, describes forming a composite image in beaded retroreflective sheet, wherein the composite image appears to be suspended above or below the sheeting (e.g., floating image). U.S. Pat. No. 8,950,877 (Northey et al), which is expressly incorporated by reference in its entirety, describes a prismatic retroreflective sheet including a first portion having a first visual feature and a second portion having a second visual feature different from the first visual feature, wherein the second visual feature forms a security mark. The different visual feature can include at least one of retroreflectance, brightness or whiteness at a given orientation, entrance or observation angle, as well as rotational symmetry. Patent Publication No. 2012/240485 (Orensteen et al), which is expressly incorporated by reference in its entirety, describes creating a security mark in a prismatic retroreflective sheet by irradiating the back side (i.e., the side having prismatic features such as cube corner elements) with a radiation source. U.S. Patent Publication No. 2014/078587 (Orensteen et al), which is expressly incorporated by reference in its entirety, describes a prismatic retroreflective sheet comprising an optically variable mark. The optically variable mark is created during the manufacturing process of the retroreflective sheet, wherein a mold comprising cube corner cavities is provided. The mold is at least partially filled with a radiation curable resin and the radiation curable resin is exposed to a first, patterned irradiation. Each of U.S. Pat. Nos. 7,068,464, 8,950,877, US 2012/240485 and US 2014/078587 are expressly incorporated by reference in its entirety.

In one or more examples, the functions described may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media, which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor", as used may refer to any of the foregoing structure or any other structure suitable for implementation of the techniques described. In addition, in some aspects, the functionality described may be provided within dedicated hardware and/or software modules. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

It is to be recognized that depending on the example, certain acts or events of any of the methods described herein can be performed in a different sequence, may be added, merged, or left out altogether (e.g., not all described acts or events are necessary for the practice of the method). Moreover, in certain examples, acts or events may be performed concurrently, e.g., through multi-threaded processing, interrupt processing, or multiple processors, rather than sequentially.

In some examples, a computer-readable storage medium includes a non-transitory medium. The term "non-transitory" indicates, in some examples, that the storage medium is not embodied in a carrier wave or a propagated signal. In certain examples, a non-transitory storage medium stores data that can, over time, change (e.g., in RAM or cache).

Various examples of the disclosure have been described. These and other examples are within the scope of the following claims.

What is claimed is:

1. A computing device comprising:

one or more computer processors, a communication device, and a memory comprising instructions that when executed by the one or more computer processors cause the one or more computer processors to:

receive, using the communication device and from a set of vehicles, different sets of infrastructure data for a particular infrastructure article of a pathway that is proximate to each respective vehicle of the set of vehicles, wherein each respective vehicle in the set of vehicles comprises at least one infrastructure sensor that generates infrastructure data descriptive of infrastructure articles that are proximate to the respective vehicle;

determine, based at least in part on the different sets of infrastructure data for the particular infrastructure article from each respective vehicle of the set of vehicles, a quality metric for the infrastructure article of the pathway;

determine whether the infrastructure article is counterfeit; and perform at least one operation based at least in part on the quality metric for the infrastructure article and perform at least one other operation based upon whether the infrastructure article is counterfeit.

2. The computing device of claim 1, wherein the infrastructure data is at least one of raw data generated by the infrastructure sensor or an identifier of the infrastructure article.

3. The computing device of claim 1, wherein the infrastructure data comprises an identifier of the infrastructure article and the infrastructure data indicates a confidence level that the identifier correctly identifies the type of the infrastructure article.

4. The computing device of claim 1, wherein the infrastructure sensor comprises one or more of image sensor, LiDAR, acoustic, radar, GPS location of infrastructure article, time sensor for detection time of infrastructure article, weather sensor for weather measurement at the time infrastructure article is detected.

5. The computing device of claim 1, wherein the quality metric for a particular article of infrastructure is based on sets of infrastructure data collected over a time series.

6. The computing device of claim 1, wherein to perform the at least one operation, the memory comprises instructions that when executed by the one or more computer processors cause the one or more computer processors to generate a confidence score associated with the quality metric that indicates a degree of confidence that the quality metric is valid.

7. The computing device of claim 1, wherein to perform the at least one operation, the memory comprises instructions that when executed by the one or more computer processors cause the one or more computer processors to, in response to a determination that the quality metric does not satisfy a threshold, send a message to a computing device associated with a custodian of the particular infrastructure article.

8. The computing device of claim 1, wherein to perform the at least one operation, the memory comprises instructions that when executed by the one or more computer processors cause the one or more computer processors to, in response to a determination that the quality metric does not satisfy a threshold, send a message to a computing device associated with a vehicle manufacturer.

9. The computing device of claim 1, wherein to perform the at least one operation, the memory comprises instructions that when executed by the one or more computer processors cause the one or more computer processors to determine that the quality metric is more than one standard deviation below the mean for similar infrastructure articles.

10. The computing device of claim 1, wherein to perform the at least one operation, the memory comprises instructions that when executed by the one or more computer processors cause the one or more computer processors to determine an anomaly in a sensor of a vehicle or an environment of the vehicle.

11. The computing device of claim 1, wherein to perform the at least one operation, the memory comprises instructions that when executed by the one or more computer processors cause the one or more computer processors to send an indication of the quality metric to at least one other vehicle for use to modify an operation of the at least one other vehicle in response to detection of the infrastructure article.

12. The computing device of claim 1, wherein to perform the at least one operation, the memory comprises instructions that when executed by the one or more computer processors cause the one or more computer processors to determine the quality metric based at least in part on infrastructure data from a plurality of infrastructure sensors that are applied to a model that predicts the quality metric.

13. The computing device of claim 1, wherein the infrastructure article is retroreflective.

14. The computing device of claim 1, wherein the infrastructure data descriptive of infrastructure articles comprises a classification that is based at least in part on raw data generated by the infrastructure sensor, and wherein the infrastructure data is generated at the respective vehicle.

15. The computing device of claim 1, wherein to determine the quality metric for the infrastructure article, the memory comprises instructions that when executed by the one or more computer processors cause the one or more computer processors to select the different sets of infrastructure data from a set of infrastructure data generated by a larger number of vehicles than the set of vehicles.

16. The computing device of claim 1, wherein the at least one infrastructure sensor of each respective vehicle generates raw data descriptive of infrastructure articles that are proximate to the respective vehicle;

wherein each respective vehicle includes at least one computer processor that pre-processes the raw data to generate the infrastructure data, wherein the infrastructure data comprises less data than the raw data.

17. The computing device of claim 16, wherein the at least one computer processor, to generate the infrastructure data, generates a quality metric for at least one infrastructure article, and wherein the at least one computer processor includes the quality metric in the infrastructure data.

18. The computing device of claim 1, wherein the computing device is included within a vehicle.

19. The computing device of claim 1, wherein the computing device is physically separate from the set of vehicles.

* * * * *